US008348274B2

(12) United States Patent
Mutsuno

(10) Patent No.: US 8,348,274 B2
(45) Date of Patent: Jan. 8, 2013

(54) SHEET PROCESSING APPARATUS, CONTROL METHOD OF SHEET PROCESSING APPARATUS, AND STORAGE MEDIUM

(75) Inventor: Masahiro Mutsuno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/639,774

(22) Filed: Dec. 16, 2009

(65) Prior Publication Data

US 2010/0156043 A1 Jun. 24, 2010

(30) Foreign Application Priority Data

Dec. 19, 2008 (JP) ..... 2008-324456

(51) Int. Cl.
*B65H 39/10* (2006.01)

(52) U.S. Cl. ..... 271/288; 271/289; 271/290

(58) Field of Classification Search ..... 271/300, 271/279, 287–290, 299; 270/58.32, 58.31
See application file for complete search history.

(56) References Cited

U.S. PATENT DOCUMENTS

| | | | | |
|---|---|---|---|---|
| 5,096,181 | A * | 3/1992 | Menon et al. | 271/157 |
| 5,903,284 | A * | 5/1999 | Sato | 346/134 |
| 6,279,892 | B1 * | 8/2001 | Yoshida et al. | 270/58.02 |
| 6,341,698 | B1 * | 1/2002 | Wursthorn | 209/552 |
| 6,494,453 | B1 * | 12/2002 | Yamada et al. | 271/288 |
| 7,597,324 | B2 * | 10/2009 | Obuchi et al. | 271/288 |
| 7,946,570 | B2 * | 5/2011 | Shinchi et al. | 271/9.02 |
| 2007/0045948 | A1 * | 3/2007 | Hanada et al. | 271/288 |
| 2008/0054557 | A1 * | 3/2008 | Hayashi et al. | 271/279 |
| 2008/0054558 | A1 * | 3/2008 | Obuchi et al. | 271/298 |
| 2008/0277867 | A1 * | 11/2008 | Moriyama et al. | 271/279 |
| 2009/0134572 | A1 * | 5/2009 | Obuchi et al. | 271/279 |
| 2009/0309300 | A1 * | 12/2009 | Obuchi et al. | 271/288 |
| 2010/0156024 | A1 * | 6/2010 | Tanaka | 271/3.14 |

FOREIGN PATENT DOCUMENTS

JP 2008-150240 A 7/2008

* cited by examiner

*Primary Examiner* — Patrick Cicchino
(74) *Attorney, Agent, or Firm* — Canon U.S.A., Inc. IP Division

(57) ABSTRACT

A control method for controlling a sheet processing apparatus having a stacking control unit configured to cause a sheet on which an image is printed by a printing unit to abut a movable abutting member, followed by stacking the sheet on a stacking unit, the control method includes: determining a position of the abutting member; and controlling a sheet which is abutted to the abutting member moved to a first position determined by the determination and mounted on the stacking unit and a sheet which is abutted to the abutting member moved to a second position determined by the determination and mounted on the stacking unit so that the sheets are mounted on said stacking unit while being prevented from overlapping from one another.

16 Claims, 19 Drawing Sheets

FIG. 17A

| | PRESENCE OR ABSENCE OF SHEET | TAB SHEET |
|---|---|---|
| STACK TRAY A | ABSENT | – |
| STACK TRAY B | ABSENT | – |

FIG. 17B

| | PRESENCE OR ABSENCE OF SHEET | TAB SHEET |
|---|---|---|
| STACK TRAY A | PRESENT | PRESENT |
| STACK TRAY B | ABSENT | – |

FIG. 17C

| | PRESENCE OR ABSENCE OF SHEET | TAB SHEET |
|---|---|---|
| STACK TRAY A | PRESENT | PRESENT |
| STACK TRAY B | PRESENT | ABSENT |

FIG. 21A

| | | PRESENCE OR ABSENCE OF SHEET | TAB SHEET |
|---|---|---|---|
| LARGE-CAPACITY STACKER 1 | STACK TRAY A | ABSENT | – |
| | STACK TRAY B | ABSENT | – |
| LARGE-CAPACITY STACKER 2 | STACK TRAY C | ABSENT | – |
| | STACK TRAY D | ABSENT | – |

FIG. 21B

| | | PRESENCE OR ABSENCE OF SHEET | TAB SHEET |
|---|---|---|---|
| LARGE-CAPACITY STACKER 1 | STACK TRAY A | PRESENT | PRESENT |
| | STACK TRAY B | ABSENT | – |
| LARGE-CAPACITY STACKER 2 | STACK TRAY C | ABSENT | – |
| | STACK TRAY D | ABSENT | – |

FIG. 21C

| | | PRESENCE OR ABSENCE OF SHEET | TAB SHEET |
|---|---|---|---|
| LARGE-CAPACITY STACKER 1 | STACK TRAY A | PRESENT | PRESENT |
| | STACK TRAY B | ABSENT | – |
| LARGE-CAPACITY STACKER 2 | STACK TRAY C | PRESENT | ABSENT |
| | STACK TRAY D | ABSENT | – |

SHEET PROCESSING APPARATUS, CONTROL METHOD OF SHEET PROCESSING APPARATUS, AND STORAGE MEDIUM

BACKGROUND OF THE INVENTION

1. Field of the Invention

The present invention relates to a sheet processing apparatus, a control method for controlling such a sheet processing apparatus, and a storage medium.

2. Description of the Related Art

Some of the sheet processing apparatuses, which have been known in the art, are provided with a sheet stacking portion designed like a stacking tray in a stacker device that stacks sheets therein, where sheets are stacked on each of the sheet stacking portion (see, for example, Japanese Patent Laid-Open No. 2008-150204).

To stack a sheet on the stacking portion, such a sheet processing apparatus employs an abutting member because of maintaining the stability of a sheet to be stacked on the stacking portion. Specifically, when ejecting a sheet, the abutting member is moved to a position at a distance corresponding to the length of the sheet from a paper ejection port in the conveyance direction. Then, the sheet to be ejected from the paper ejection port is abutted to the abutting member to stack the sheet by dropping the sheet to the stacking unit with the own weight of the sheet.

In addition, one of the conventional sheet processing apparatuses is designed so that an abutting member can change its position depending on the type of a sheet. Such a kind of the sheet processing apparatus prevents an ejecting sheet from jamming into an ejection port by changing the position of an abutting member or preventing an ejected sheet from protruding from a stacking unit.

For example, there is a need of changing the position of the abutting member when ejecting a sheet of A4 standard paper and when ejecting an A4 tab sheet. Such a change in position of the abutting member may reduce the possibility of causing the tab of the tab sheet to jam into the ejection port or prevent the tab of the tab sheet from protruding from the stacking tray.

However, when determining the position of the abutting member depending on the type of the sheet, the abutting member is located at any of different positions depending on different sheet types. Thus, the stacked sheets being abutted on the abutting member may be displaced from their suitable positions. Therefore, the stability of the stacked sheets tends to be reduced.

SUMMARY OF THE INVENTION

An aspect of the present invention is a sheet processing apparatus that includes: a stacking control unit configured to cause a sheet on which an image is printed by a printing unit to abut a movable abutting member (e.g., an abutting plate), followed by stacking the sheet on a stacking unit; a determining unit configured to determine the position of the abutting member; and a control unit configured to control a sheet which is abutted to the abutting member moved to a first position determined by the determining unit and mounted on the stacking unit and a sheet which is abutted to the abutting member moved to a second position determined by the determining unit and mounted on the stacking unit so that the sheets are mounted on said stacking unit while being prevented from overlapping from one another.

Further features of the present invention will become apparent from the following description of exemplary embodiments (with reference to the attached drawings).

BRIEF DESCRIPTION OF THE DRAWINGS

FIG. 17 is a diagram illustrating a stacking state management table according to the embodiment of the present invention;

FIG. 21 is a diagram illustrating a stacking state management table according to the embodiment of the present invention.

DESCRIPTION OF THE EMBODIMENTS

First Embodiment

Figure 1:
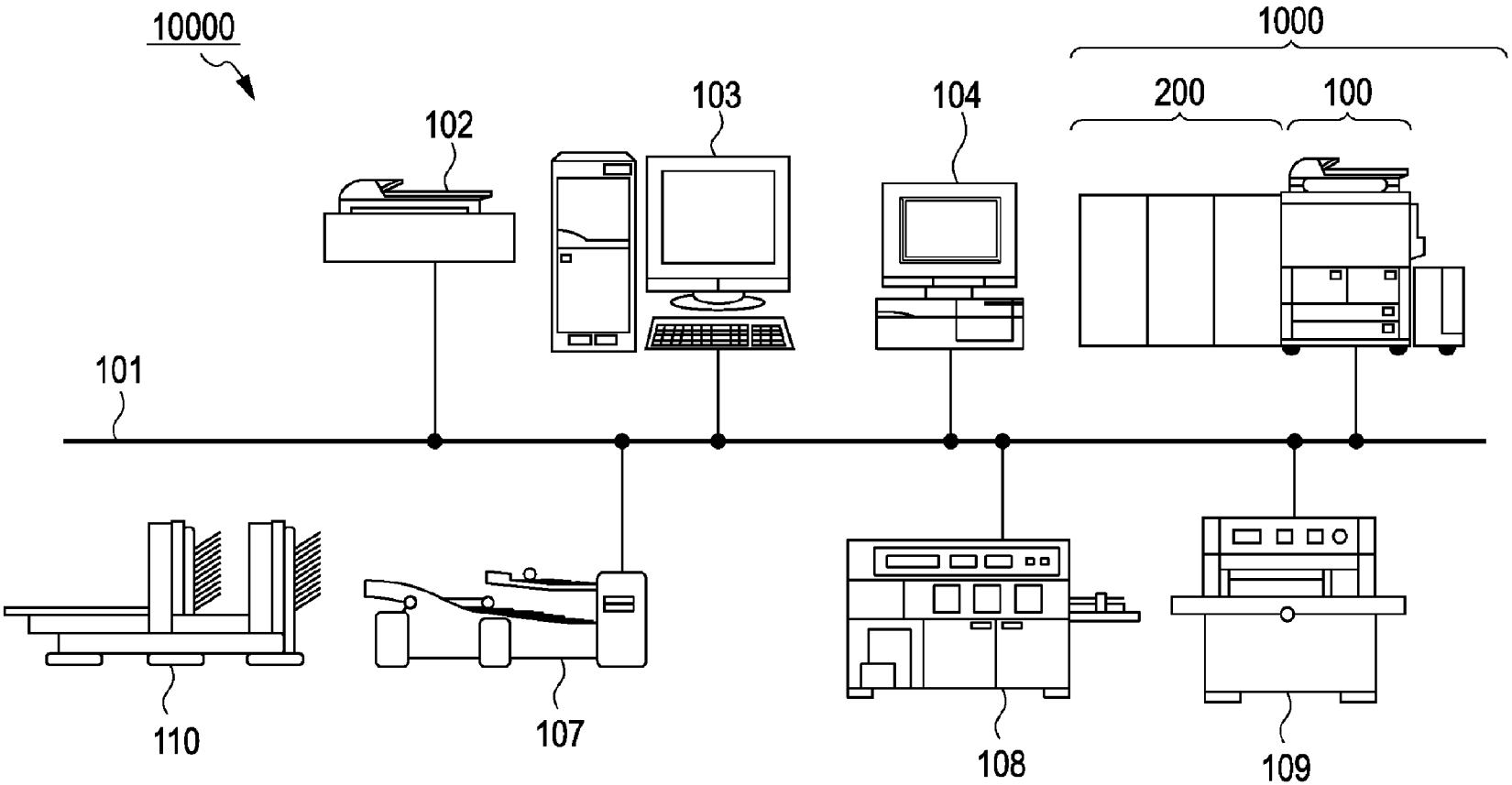
FIG. 1 is a diagram illustrating the configuration of a POD system 10000 according to an embodiment of the present invention.

FIG. 1 illustrates the configuration of a print-on-demand (POD) system 10000 including a printing system as an example of a sheet processing apparatus of an embodiment of the present invention.

The POD system 10000 includes a printing system 1000, a server computer 103, a client computer (PC) 104. The POD system 10000 also includes a scanner 102, a paper folding machine 107, a case binding machine 108, a trimmer 109, and a saddle stitch binding machine 110. The constitutional members of the POD system 10000 other than the saddle stitch binding machine 110 are connected to one another through network 101.

The printing system 1000 includes a printer 100 and a sheet processing apparatus 200.

The printer 100 receives print data from the PC 104 and then performs printing on a sheet according to the received print data, followed by allowing the sheet processing apparatus 200 to process the printed sheet if required. Hereinafter, the printer 100 will be described using an image scan apparatus, a multifunction peripheral (MFP) having a plurality of functions, such as a copying function and a PC printing function. Alternatively, however, it may be a single-function printer only having a PC printing function.

The paper folding machine 107, the case binding machine 108, the trimmer 109, and the saddle stitch binding machine 110 are defined as apparatuses for performing post processing of the printed sheet, similar to the sheet processing apparatus 200 installed in the printing system 1000. The user takes out the sheet printed by the printer 100 from the paper ejecting section of the printing system 1000 and sets the taken-out sheet in the sheet processing apparatus to perform the post processing. For example, the user allows the paper folding machine 107 to execute folding of the printed sheet. In addition, the user allows the case binding machine 108 to execute case binding of the printed sheet. Furthermore, the user allows the trimmer 109 to execute trimming of the printed sheet. Still furthermore, the user allows the saddle stitch binding machine 110 to execute saddle-stitch binding of the printed sheet.

Next, with reference to FIG. 2, the configuration of the printing system 1000 will be described.

Figure 2:
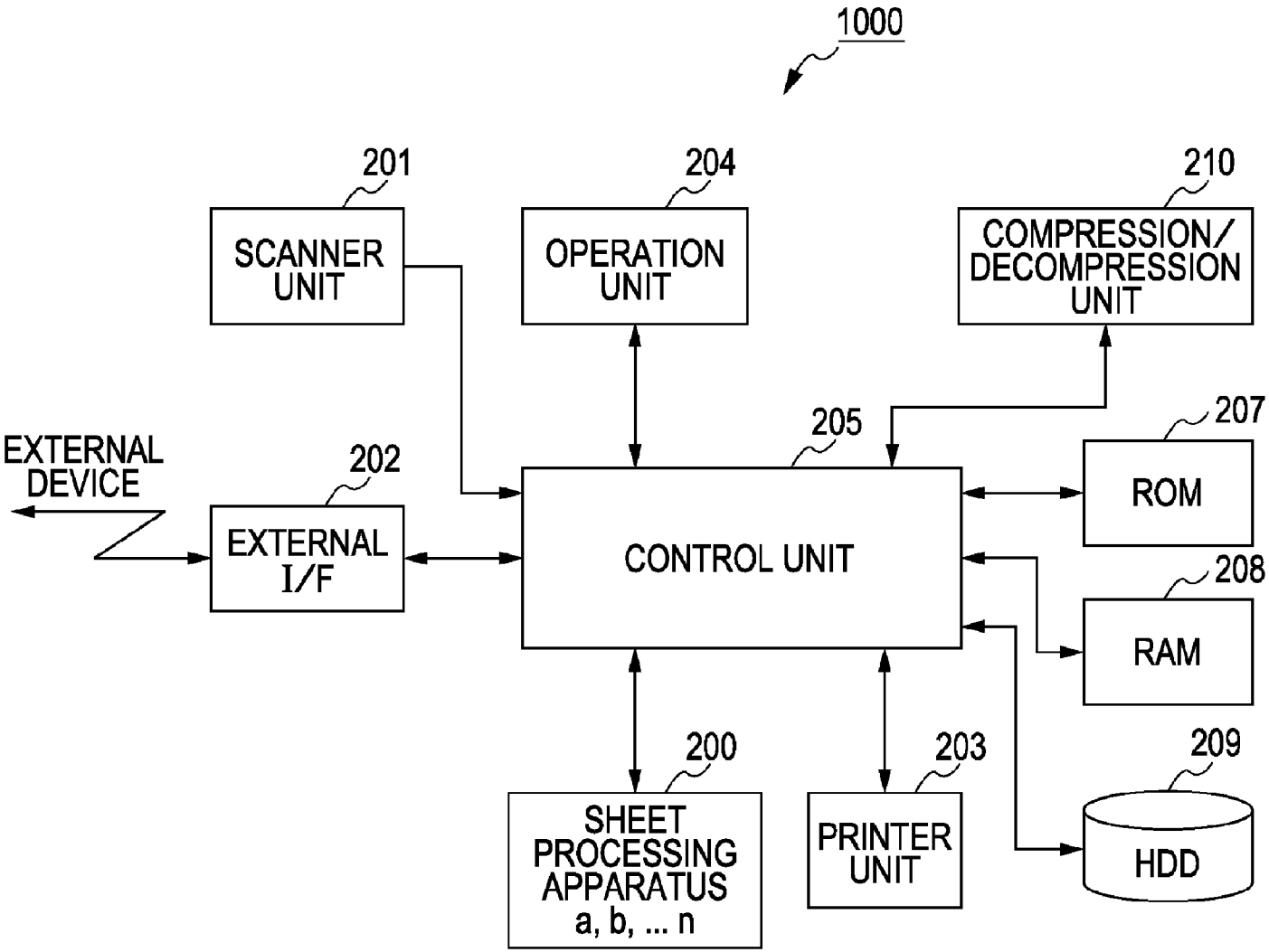
FIG. 2 is a block diagram illustrating the configuration of a printing system 1000 according to the embodiment of the present invention.

FIG. 2 is a block diagram that illustrates the configuration of the printing system 1000. The printing system 1000 includes a scanner unit 201, an external interface (I/F) unit 202, a printer unit 203, an operation unit 204, a control unit 205, a read-only memory (ROM) 207, a random access memory (RAM) 208, and a hard disk drive (HDD) 208. These constitutional members of the printing system 1000 are connected to one another through an internal bus of the printing system 1000.

The control unit 205 reads out a program stored in the ROM 207 to centrally control the printing system 1000.

The scanner unit 201 reads an original and then generates the image data of the read original. The generated image data is transmitted to the control unit 205.

The external I/F unit 202 controls the transmission/reception of data between the control unit 205 and external networks 101. For example, the external I/F unit 202 transmits image data transmitted from the external device, such as the PC 104, to the control unit 205. In addition the external I/F unit 202 transmits the data received from the control unit 205 to the external device such as the PC 104 through the network 101.

The printer unit 203 prints the image data received from the control unit 205 on a sheet according to print settings (information about print layout, the number of sets, and so on) received from the control unit 205.

The operation unit 204 includes a main display, a touch panel, hard keys, and so on. The operation unit 204 displays an operation screen on the main display and receives instructions from the user through a touch panel on the main display. In addition, the operation unit 204 may receive instructions from the user through the hard keys. Subsequently, the operation unit 204 transmits the received instructions to the control unit 205.

The ROM 207 stores a program to be executed by the control unit 205.

The RAM 208 functions as a work memory of the control unit 205 and temporarily stores the program and the image data read out from the ROM 207.

The HDD 209 is a nonvolatile storage medium. The HDD 209 stores the data of jobs to be executed in the order of execution.

For example, when executing a copy job, the control unit 205 stores the image data read from the scanner unit 201 as a job in the HDD 209 while associating the job with the print settings received from the user through the operation unit 204. Then, the stored job is executed. The control unit 205 executes the job stored in the HDD 209 to allow the printer unit 203 to print the image data according to the print settings stored in association with the image data stored in the HDD 209.

Furthermore, when executing the print job, the control unit 205 associates the image data received through the external I/F unit 202 with the print settings to store the image data as a job in the HDD 209, followed by executing the stored job. The control unit 205 executes the job stored in the HDD 209 to print the image data stored in the HDD 209 on a sheet on the basis of the print settings stored in association with the image data.

The HDD 209 can store a plurality of jobs, and the control unit 205 can execute these stored jobs in the order of reception. Here, the user may change the execution sequence of the jobs. Also, the control section 205 may change the execution sequence if a predetermined requirement is satisfied.

The compression/decompression unit 210 performs compression and decompression processing on the image data stored in the RAM 208 or the HDD 209 based on various compression formats, such as Joint Bi-level Image Experts Group (JBIG) or Joint Photographic Experts Group (JPEG).

The sheet processing apparatus 200 is connected to the printer 100 and performs various kinds of sheet processing, such as sheet loading, case binding, and saddle-stitch binding, on the sheet printed by the printer 100.

Figure 3:
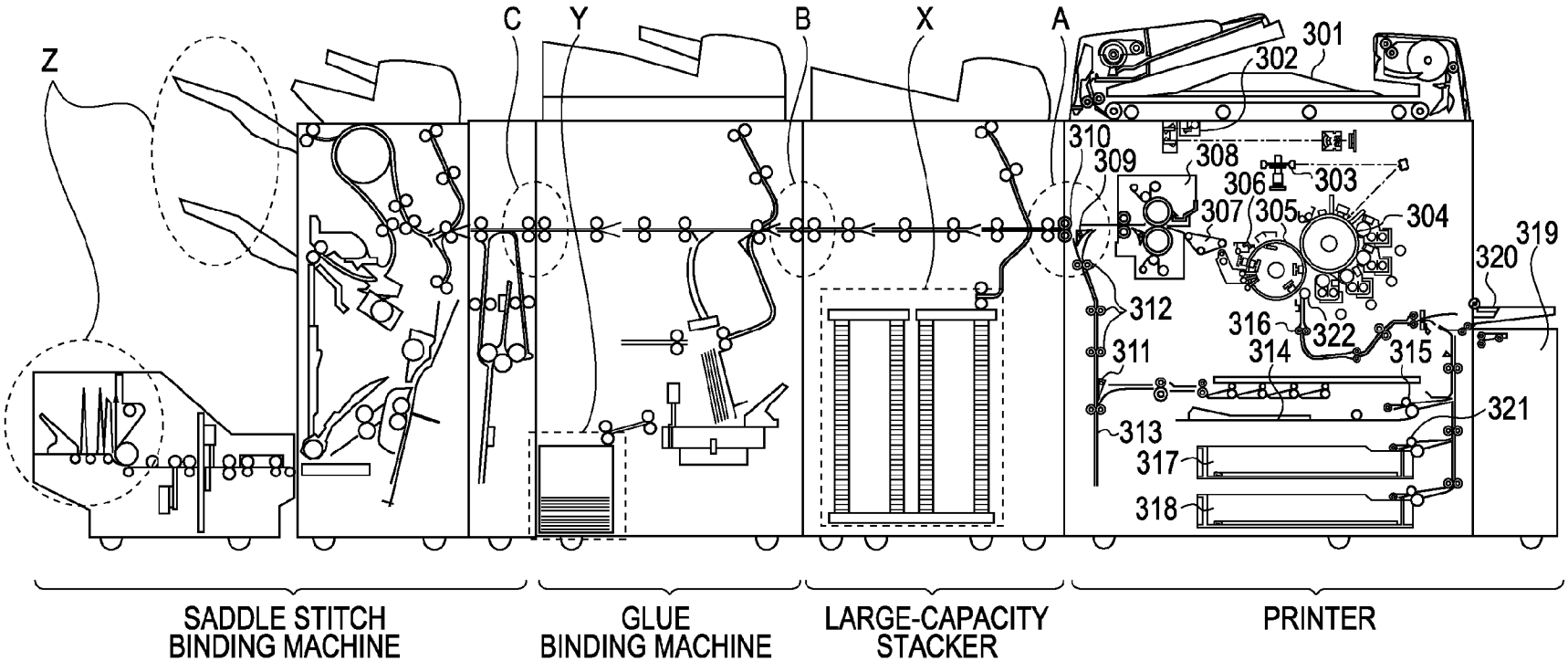
FIG. 3 is a cross-sectional diagram illustrating the configuration of the printing system 1000 according to the embodiment of the present invention.

Referring now to FIG. 3, the configuration of the printing system 1000 will be described.

FIG. 3 is a cross-sectional view of the printing system 1000.

In the present embodiment, the printer 100 is a single-drum (1D) type color multifunction device. However, the present invention is not limited to this. That is, a monochromatic multifunction device or a four-drum (4D) type MFP may be used as the printer 100. Here, the composite machine is also called a multi-function peripheral (MFP).

An auto document feeder (ADF) 301 separates an original document set on a document tray page by page from the first page. Then, the ADF 301 feeds the original document onto a document positioning glass to scan the document with a reading unit 302. The reading unit 302 reads an image on the document that has been conveyed onto the document positioning glass and converts the read document image into image data with an image sensor, such as a charge-coupled device (CCD). A ray, such as a laser beam, which has been modulated according to the image data, is made incident on a rotating polygonal mirror 303. The laser beam reflected from a rotating multifaced mirror (e.g., a rotating polygonal mirror) and then irradiated on the surface of a photosensitive drum 304 through a reflection mirror. The latent image formed on the surface of the photosensitive drum 304 with the ray is then developed with toner.

Furthermore, the printer 100 conveys a sheet fed from any one of paper feed cassettes 317 through 320, each of which is an example of a paper feed unit, to a registration roller 316. The printer 100 further attaches the sheet to a transfer drum 305 to transfer a toner image on a photosensitive drum 304 onto the sheet attached to the transfer drum 305.

By serially performing a series of image forming processing on toners of colors of yellow (Y), magenta (M), cyan (C), and black (K), a full color image is formed. After performing four-image forming processing, a sheet on the transfer drum 305, onto which a full color image has been formed, is then separated from the transfer drum 305 by a separation claw 306. Then, the separated sheet is fed to a fixing device 308 by a pre-fixing conveyance unit 307. The fixing device 308 includes rollers and a belt in combination with one another. Furthermore, the fixing device 308 includes therein a heat source such as a halogen heater. The fixing device 308 applies heat and pressure to the toner on the sheet having the transferred toner image. Thus, the toner on the sheet having the toner image can be fused and fixed. A sheet discharge flapper 309 can swing around an axis to regulate the direction of conveying a sheet. When the sheet discharge flapper 309 swings clockwise in the figure, the sheet is conveyed in a straight direction. Subsequently, a paper discharge roller 310 feeds the sheet to a large-capacity stacker 200*a*.

On the other hand, in performing a two-sided print job, the sheet discharge flapper 309 swings counterclockwise in the figure to change the path of the sheet to a downward direction. As a result, the sheet is fed into a two-sided conveyance unit. The two-sided conveyance unit includes a reversal flapper 311, a reversal roller 312, a reversal guide 313, and a two-sided tray 314. The reversal flapper 311 swings around a rocking shaft around an axis and regulates the direction of conveying the sheet. When processing a double-side print job, the control unit 201 controls the reversal flapper 311 to swing counterclockwise in the figure. Thus, the sheet having the image-printed first surface can be fed to the reversal guide 313 through the conveying roller 312. Then, the control unit 201 temporarily stops the reversal roller 314 in the state where the posterior edge of the sheet is pinched by a reversal roller 324. Subsequently, the control unit 201 allows the reversal flapper 311 to swing clockwise in the figure to rotate the reverse roller 324 in the reverse direction. As described above, the control unit 201 performs control so that the sheet is switched back to be conveyed. The control unit 201 performs control to guide the sheet to the two-sided tray 314 in the state where the leading edge and trailing edge of the sheet have been changed in position. The two-sided tray 314 temporarily holds the sheet. After that, the sheet can be conveyed again to the registration roller 316 by a paper feed roller 315. At this time, the sheet is fed with a surface thereof opposite to the first surface used in the transfer processing facing the photosensitive drum 304. Then, the control unit 201 performs control to form an image on the second surface of the sheet as in the processing described above. Thus, images are formed on both sides of the sheet. Then, the sheet is subjected to fixing processing by the fixing device 308. After that, the sheet is conveyed to the subsequent apparatuses by the paper discharge roller 310.

The sheet of the job set to stack the sheet on the large-capacity stacker among the subsequent apparatuses is conveyed to the large-capacity stacker so that it can be stacked thereon. In addition, the sheet of the job set to bind a book by the glue binding machine is conveyed to the glue binding machine. Furthermore, the sheet of the job set to perform saddle stitch binding is conveyed to the saddle stitch binding machine.

Subsequently, the sheets are subjecting to sheet processing in the sheet processing apparatuses and then ejected to the paper ejecting sections thereof, respectively.

Figure 4:
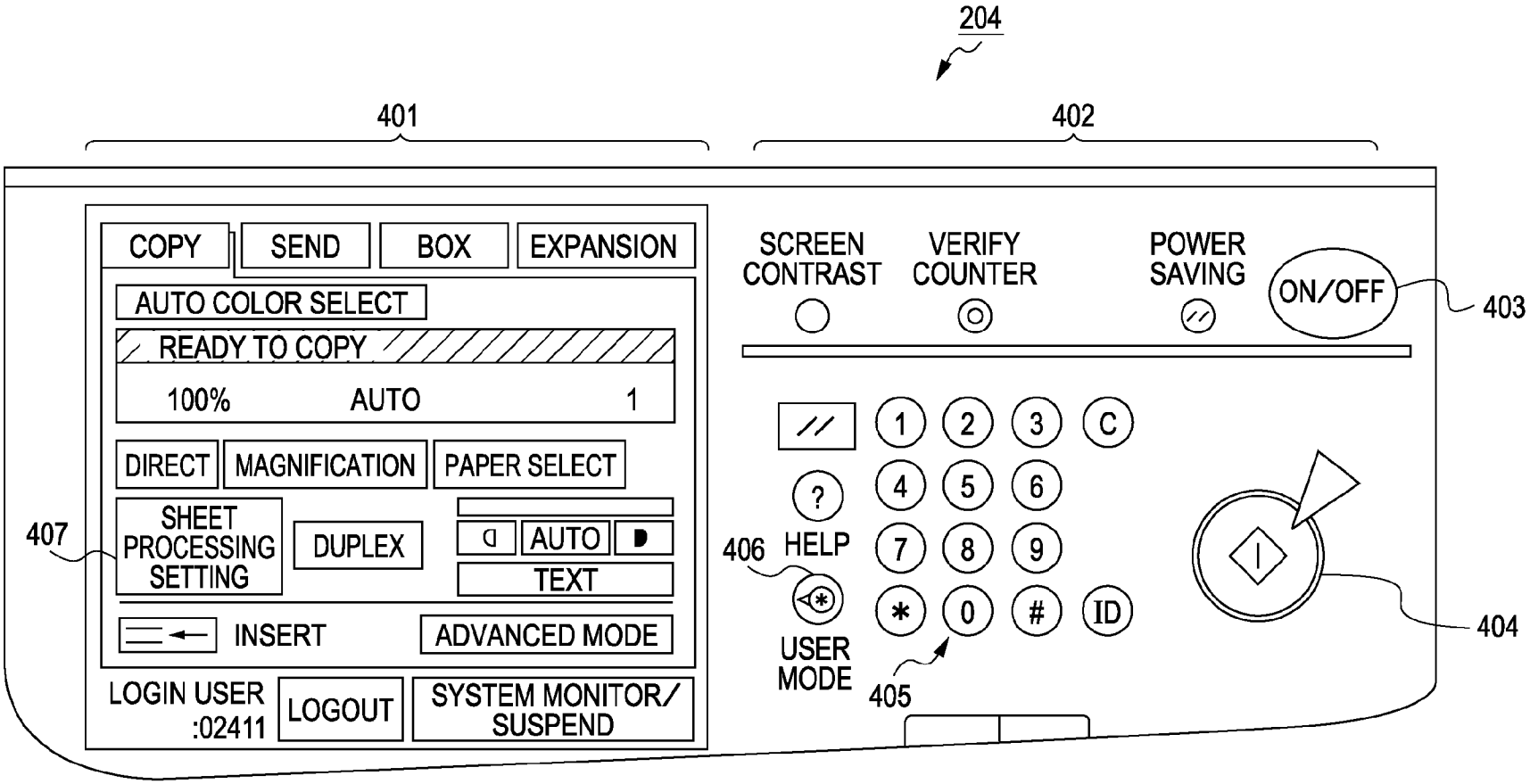
FIG. 4 is a schematic diagram illustrating an operation unit 204 according to the embodiment of the present invention.

FIG. 4 is a diagram illustrating the configuration of the operation unit 204.

The operation unit 204 includes a touch panel section 401 having soft keys and a key input section 402 having hard keys.

The touch panel section 401 includes a liquid crystal display (LCD) and a touch panel attached on the LCD. The touch panel section 401 receives instructions from the user. In addition, the touch panel section 401 notifies the user by displaying various messages thereon.

When a copy tab on the touch panel section 401 is pressed by the user, an operating screen for the copy function is displayed on the touch panel section 401. When the transmission tab 602 is pressed by the user, an operating screen with a data sending (Send) function, such as fax or E-mail, is displayed on the touch panel section 401. When a box tab is pressed by the user, an operating screen for the box function is displayed on the touch panel section 401. The term "box function" means a function that the image data read by the scanner unit 201 is previously stored in the HDD 209, the print data stored in the HDD 209 is then selected with desired timing, and the selected print data is printed by the printer unit 203.

A power switch 403 is a button for switching the mode of the printing system 1000 between a standby mode (normal operation state) and a sleep mode (state of stopping a program in an interrupt-standby state in anticipation of network printing, facsimile, or the like, and suppressing power consumption).

A start key 404 is a key for enabling the user to instruct the printing apparatus 100 to start the types of jobs instructed by the user, such as copying operations or sending operations.

A numeric keypad 405 is a set of keys for enabling the user to set the number of copies, input of a password, and so on.

A user mode key 406 is a key for enabling the user to perform various types of settings of the printing system 1000.

A sheet processing set key 407 is a key for enabling the user to set sheet processing performed by the sheet processing apparatus 200. If the sheet processing set key 407 is pressed, then the control unit 205 displays a screen shown in FIG. 5 on the touch panel unit 401.

Figure 5:
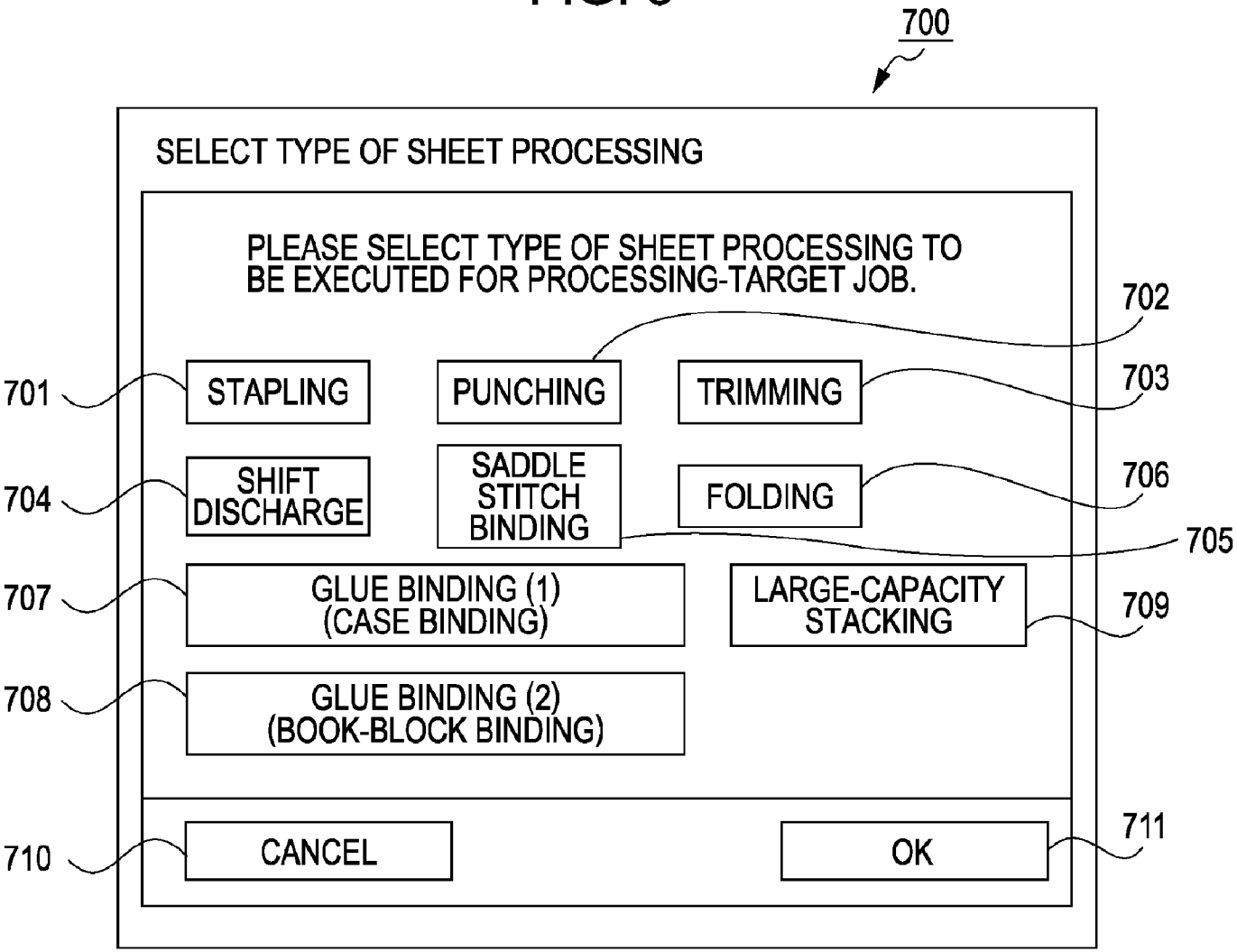
FIG. 5 is a diagram illustrating a screen for receiving settings of sheet processing according to the embodiment of the present invention.

The screen shown in FIG. 5 displays keys for receiving settings of seat processing executable by the printing system 1000. The types of the executable seat processing may be changed depending on the configuration of the printing system 1000.

The keys represented in FIG. 5 include keys for performing various kinds of processing of:

(1) stapling (key 701);
(2) punching (key 702);
(3) trimming (key 703);
(4) shift paper ejecting (key 704);
(5) saddle-stitch binding (key 705);
(6) folding (key 706);
(7) case binding (key 707);
(8) glue binding (key 708); and
(9) large-capacity stacking (key 709).

Among these kinds of processing (1) to (9), the control unit 205 enables the printer 100 to perform the sheet processing selected through the screen shown in FIG. 5 on a sheet printed by the printer 100.

For example, if the OK key 711 is pressed while the key 705 is being selected in the copy function and then the start key 401 is pressed, the control unit 205 allows the scanner unit 201 to read the original. Then, the control unit 205 prints the image data of the read original depending on the print settings received through the operation unit 204. Subsequently the control unit 205 conveys the printed sheet to the saddle stitch binding machine shown in FIG. 3 and then allows the saddle stitching binding machine to perform saddle-stitching binding.

Furthermore, in the copy function, if the OK key 711 is pressed while the key 709 is being selected, then the control unit 205 allows the scanner unit 201 to read an original when the start key 404 is pressed. Subsequently, the control unit 205 allows the printer unit 203 to print the image data of the read original according to the print settings received from the user through the operation unit 204. After that, the control unit 205 feeds the printed sheet to a large-capacity stacker 600 shown in FIG. 3 and then allows the large-capacity stacker 600 to execute large-capacity stacking.

The control unit 205 receives settings for inserting a tab paper through the operation unit 204. The control unit 205 displays a screen for setting of whether or not to insert the tab paper in response to pushing of an "advanced mode" button 408 shown in FIG. 4. Then, the control unit 205 receives a setting of whether or not to insert the tab paper and a setting of determining a position where the tab paper will be inserted (determining the numbers of the corresponding sheets from the uppermost sheet, where the tab sheet will be inserted). Furthermore, the control unit 205 stores the received settings as job information and executes a job which is set to insert the tab paper when the start key 404 is pressed.

Figure 6:
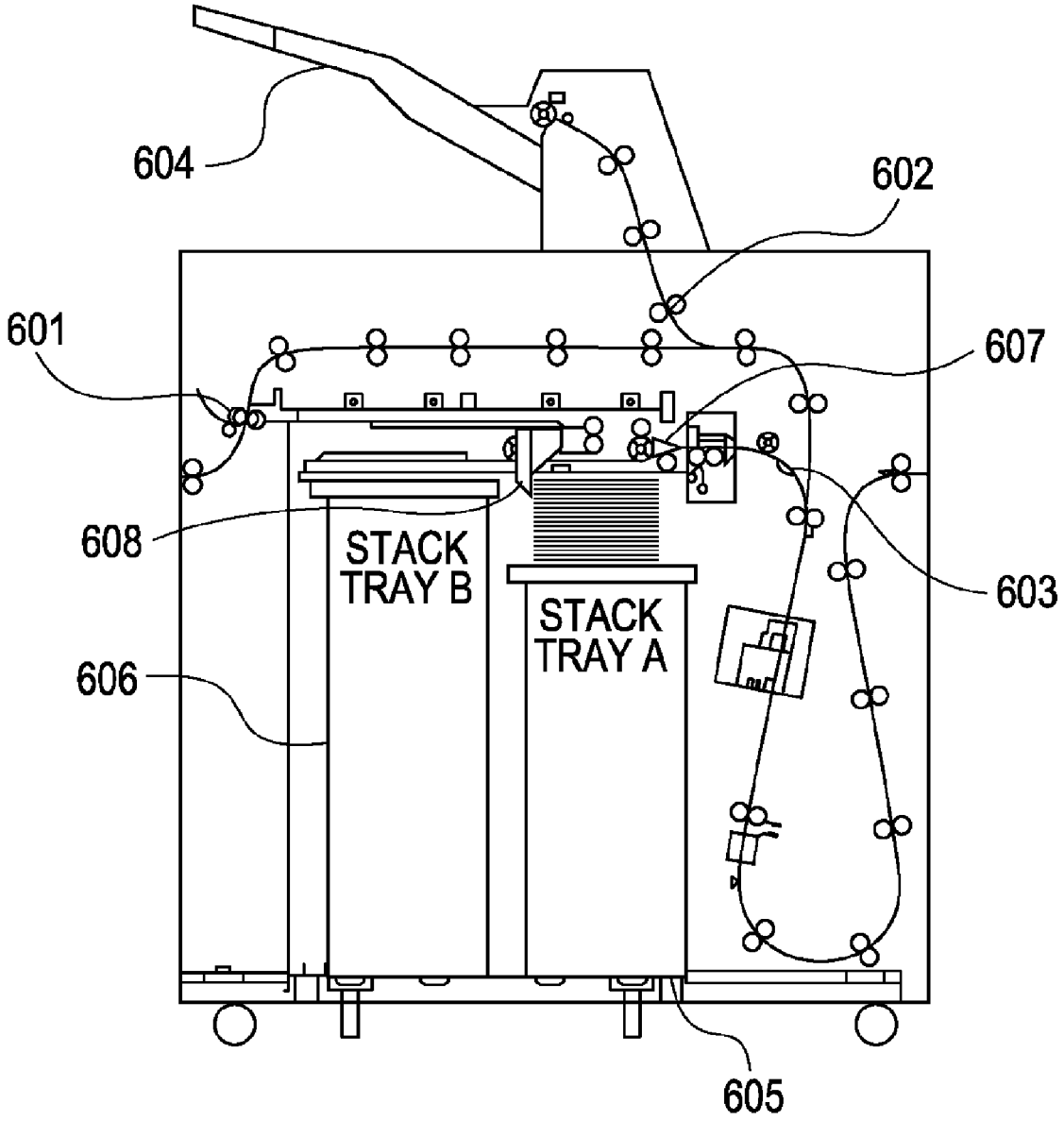
FIG. 6 is a cross-sectional diagram illustrating the configuration of a large-capacity stacker according to the embodiment of the present invention.

FIG. 6 is a diagram that illustrates an exemplary configuration of the large-capacity stacker. Here, the shape of a sheet conveying path is not limited to one shown in FIG. 6. Alternatively, the large-capacity stacker may be shaped like one shown in FIG. 3.

The large-capacity stacker includes a straight path 601, an escape path 602, and a stack path 603.

The straight path 601 is a sheet-conveying path for conveying sheets received from a previous apparatus (the printer 100 in this embodiment) to a later apparatus (the case binding machine in this embodiment). The straight path 601 within the large-capacity stacker is a sheet conveyance path for sending the sheets of a job not requiring sheet stacking to the later apparatus.

The escape path 602 is provided for conveying a sheet to an escape tray 604.

The stack pass 603 is a sheet-conveying path for conveying printed sheets to load them on a stack tray A or B (also referred to as stacking unit or loading trays) by executing the job specified to load (stack) the sheets on the large-capacity stacker.

The large-capacity stacker includes two stack trays (loading trays) A and B on which sheets can be stacked. Each of the stack trays A and B are attached on a cart 605 by an expandable stay 606. The cart 605 is provided with a handle 611 as shown in FIG. 17 to enable the user to carry the sheets loaded on each of the stackers A and B from one sheet processing apparatus to another sheet processing apparatus. When receiving an instruction of opening the front door (not shown) of the large-capacity stacker, each stack tray descends to a position shown in FIG. 17 to allow the user to easily carry the stack tray with the cart 605. In addition, each of the stack trays A and B moves to an upper position shown in FIG. 6 to easily load the sheets ejected from the stack path 607 onto the stack tray in response to the attachment of the cart on the large-capacity stacker. As shown in FIG. 6, each of the stack trays A and B moves upward so that the uppermost surface of the sheets loaded on the stack tray can reach the same level as that of the stacker path.

Then, the control unit 205 performs control so that the flapper 607 introduces the sheet ejected from the stack path to the stack tray A or the stack tray B and then stacked on the stack tray A or the stack tray B. In the case of stacking the sheet on the stack tray A, the sheet is guided to the stack tray A along a downward sheet-conveying path by the flapper 607 and then ejected to the stack tray A. In addition, in the case of stacking the sheet on the stack tray B, the flapper 607 allows the sheet to be conveyed by the upward conveying path. Thus, the sheet can be ejected to the stack tray B.

Figure 10:
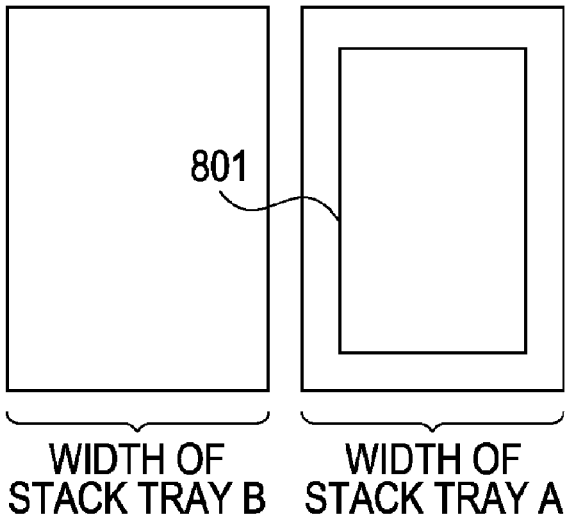
FIG. 10 is a diagram illustrating a stacking state of a stack tray according to the embodiment of the present invention.

Each of the sheets to be stacked on the stack tray A and the stack tray B can be ejected in a state that the sheets are conformably stacked one on top of the other by an abutting plate 608. The abutting plate 608 is designed so that it can be moved from side to side in FIG. 6 (in the direction of conveying the sheet). For example, when ejecting a sheet to the stack tray A, for conformably stacking the ejected sheets one on top of the other, the stacking plate is moved to a position at a distance from the ejection port of the stack path 603 to a position at a distance corresponding to the length of the sheet to be ejected in the conveyance direction from the ejection port of the stack path 603 as shown in FIG. 6. The sheet is stacked on the stack tray A while the sheet ejected from the ejection port of the stack path is being conformed to the position of the abutting plate 608. Such a state of the sheet stacked on the stack tray A is illustrated in FIG. 10. FIG. 10 is a top view of the stack trays A and B. In FIG. 10, a plurality of the same-size sheets 801 are stacked on the stack tray A.

As shown in FIG. 10, the sheets can be conformably stacked on the stack tray A by allowing the abutting plate 608 to be located at a position almost corresponding to the length of the sheets in the conveyance direction thereof. If the distance from the ejection port of the stack path 603 to the position of the abutting plate 608, the leading edge of the ejecting sheet may be hardly abutted to the abutting plate 608. In addition, after the abutment, the sheet may bounce off and may be then stacked at an unconformable position which is distant from the abutting plate 608. Therefore, the position of the abutting plate 608 is preferably shifted to a position at a distance corresponding to the length of the sheet in the conveyance direction thereof from the ejection port of the sheet.

Therefore, a position of this abutting plate 608 is determined based on the length of a sheet and the conveyance direction thereof. For example, in the sheet is of an A4 size, the abutting plate 608 is moved at a position corresponding to the length of the A4 sheet in the conveyance direction thereof from the ejection port. Alternatively, if the sheet is of a B5 size, the abutting plate 608 is moved at a position corresponding to the length of the B5 sheet in the conveyance direction thereof from the ejection port.

Figure 11:
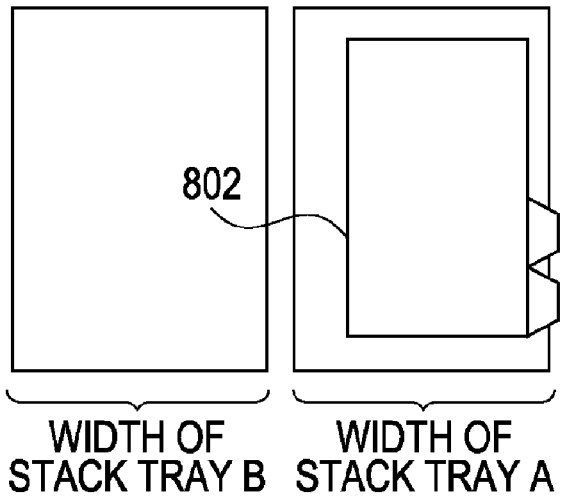
FIG. 11 is a diagram illustrating a stacking state of a stack tray according to the embodiment of the present invention.

Even in the case of using the A4 sheets, the abutting plate 608 is placed at different positions depending on whether the sheet is a standard sheet or a tab sheet. For example, in the case of ejecting a tab sheet by executing a job which is set to insert a tab sheet between standard sheets, the tab of the tab sheet may be jammed into the ejection port as shown in FIG. 11 depending on the size of the stack tray when the abutting plate 608 is located at the same position as one illustrated in FIG. 6. In addition, there is a possibility that the tab of the tab sheet may protrude from the tray. When the tab sheet protrudes from the tray in this way and the stacked sheets are conveyed, the protruded portion may bump into an obstacle and as a result the stacked sheets may collapse.

Figure 7:
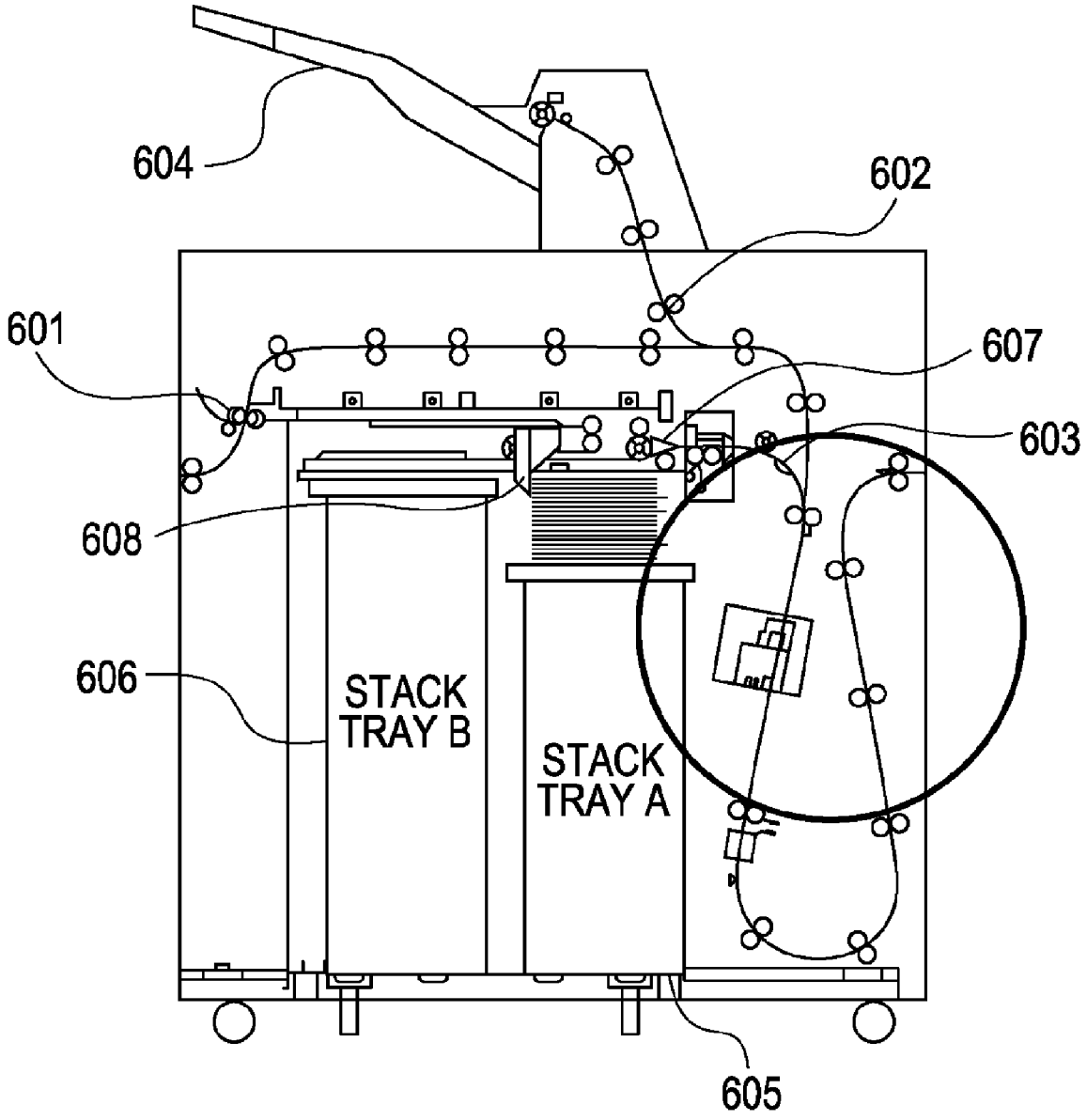
FIG. 7 is a cross-sectional diagram illustrating the configuration of a large-capacity stacker according to the embodiment of the present invention.
Figure 12:
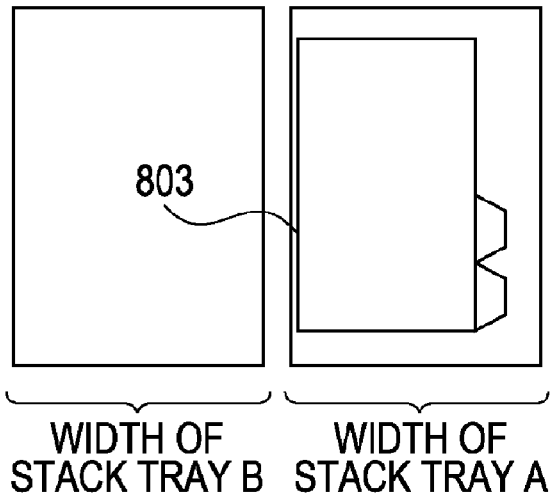
FIG. 12 is a diagram illustrating a stacking state of a stack tray according to the embodiment of the present invention.

Therefore, the control unit 205 allows the abutting plate 608 to be moved to a position at a distance longer than the length of the sheet in the conveyance direction thereof to prevent the ejecting tab sheet (the tab of the tab sheet) from jamming into the ejection port or protruding from the tray. The configuration of the large-capacity stacker under such conditions is illustrated in FIG. 7. Such a configuration of the large-capacity stacker can prevent the tab of a tab sheet to be stacked on the stack tray from jamming into the ejection port or protruding from the stack tray A. At this time, the sheets 803 can be stacked as shown in FIG. 12 and the tab of the tab sheet can be prevented from protruding from the stack tray B. Thus, the position of the abutting plate 608 can be determined based on the size of the sheet, such as A4 or B5, the length of the sheet in the conveyance direction thereof, and the type of the sheet (standard or tab sheet).

Figure 8:
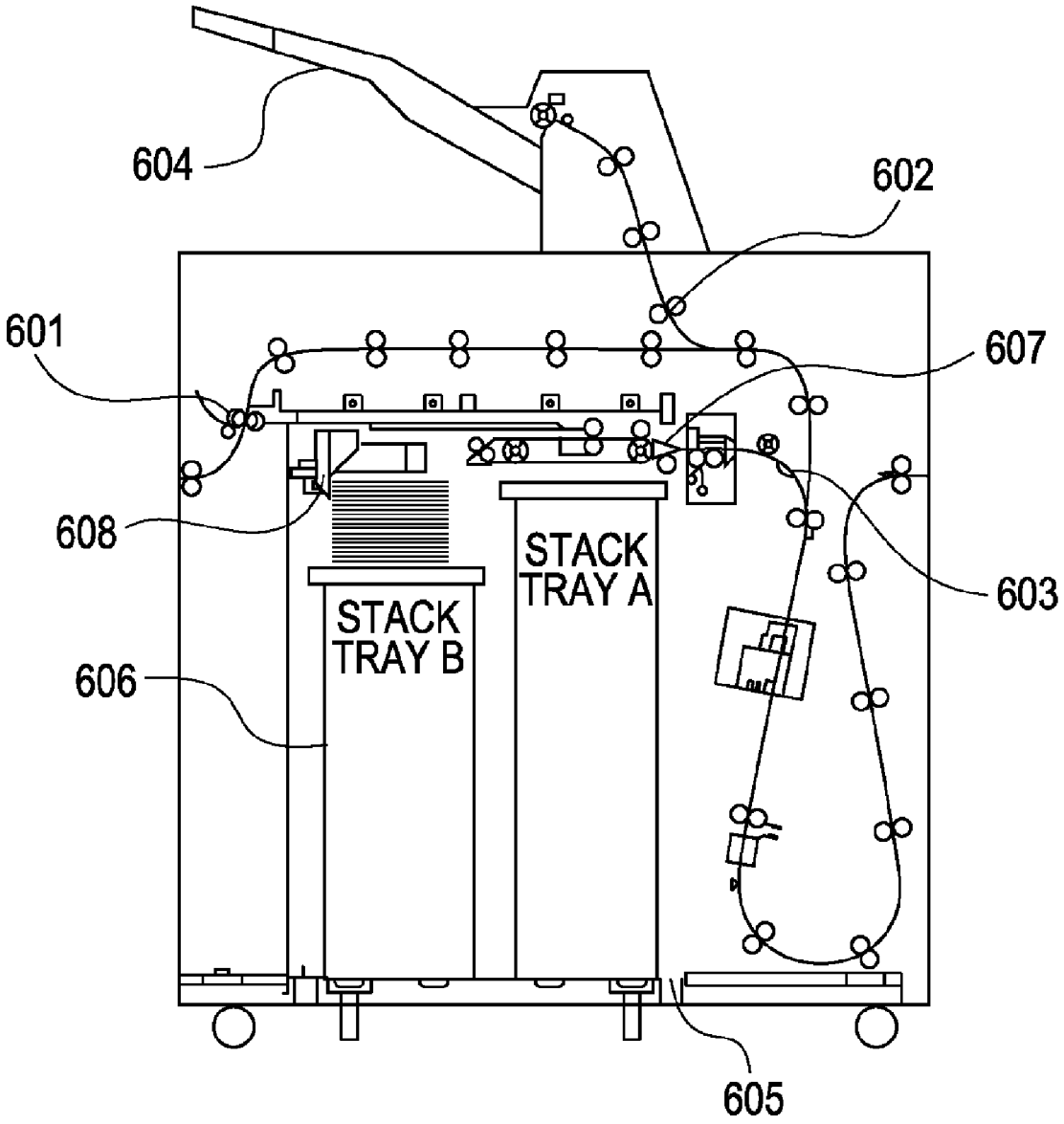
FIG. 8 is a cross-sectional diagram illustrating the configuration of a large-capacity stacker according to the embodiment of the present invention.
Figure 9:
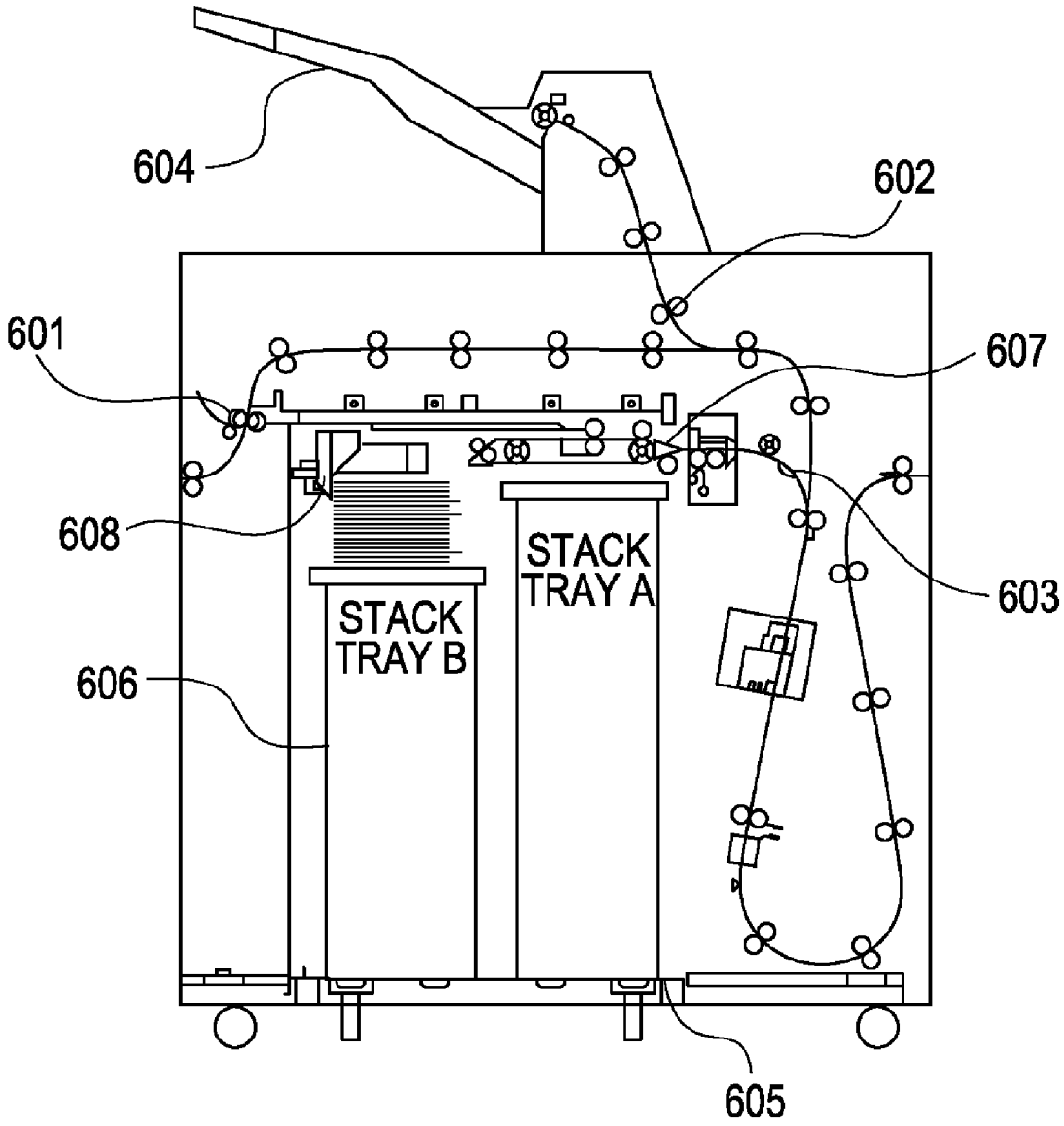
FIG. 9 is a cross-sectional diagram illustrating the configuration of a large-capacity stacker according to the embodiment of the present invention.
Figure 13:
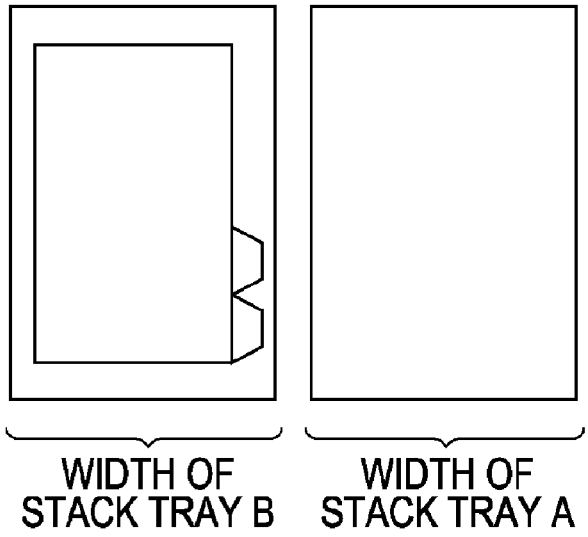
FIG. 13 is a diagram illustrating a stacking state of a stack tray according to the embodiment of the present invention.

The ejection of sheets to the stack tray B can be controlled, similarly. In the case of executing a job which is not set to insert a tab sheet between standard sheets, the abutting plate 608 is shifted from the position shown in FIG. 7 to a position shown in FIG. 8. On the other hand, in the case of executing a job which is set to insert a tab sheet between standard sheets, the abutting plate 608 is shifted to a position shown in FIG. 9. Even if the job which is set to insert the tab sheet between the standard sheets, as shown in FIG. 13, the sheet corresponding such a job can prevent the sheets set to insert a tab sheet therebetween from protruding from the stacker the tray B.

Figure 14:
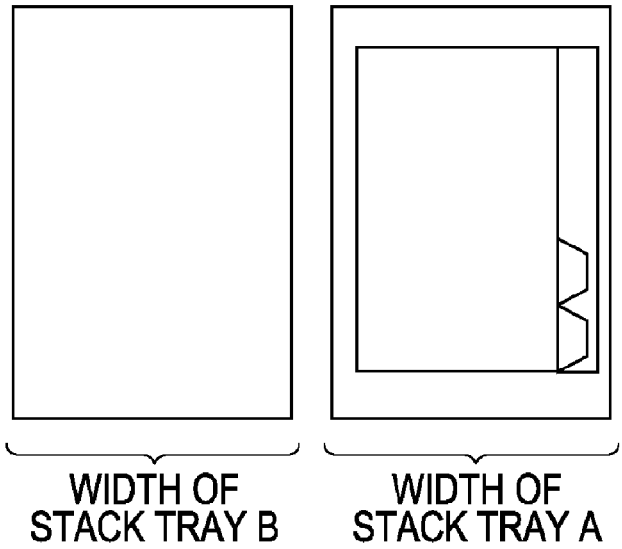
FIG. 14 is a diagram illustrating a stacking state of a stack tray according to the embodiment of the present invention.

When stacking sheets by such two different stacking methods, considering that sheets are stacked on the stack tray A by the job which is not set to insert a tab sheet between the standard sheets is executed and the job which is set to insert a tab sheet between the standard sheets is then executed, the sheets are stacked on the stack tray A as shown in FIG. 10 and then stacked thereon as shown in FIG. 14.

Figure 15:
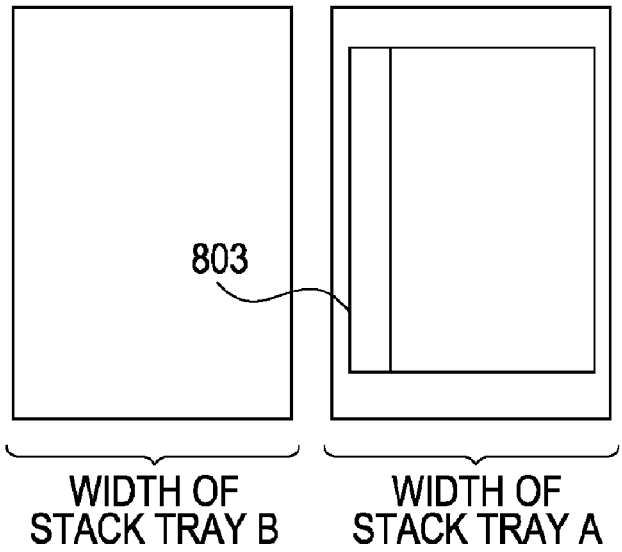
FIG. 15 is a diagram illustrating a stacking state of a stack tray according to the embodiment of the present invention.

Alternatively, in the inverse order, if the sheet is stacked by the job which is not set to insert the tab sheet, and the sheet is then by the job set to insert the tab sheet, the sheets stacked on the stack tray A can be represented as shown in FIG. 15.

In this way, if the sheets set to insert the tab sheet therebetween and the sheets not set to insert the tab sheet therebetween are stacked so as to be mixed together, the displacement of sheets may be caused in the stacked sheets. Therefore, it may become difficult to maintain the stability of the stacked sheets. In particular, such a displacement may have a significant impact on the sheet when the height of the stacked sheets is high or when the sheets are conveyed by the cart 605.

In the present embodiment, therefore, the control unit 205 performs control so that the sheets which are set to insert the tab sheet therebetween and the sheets which are not set to insert the tab sheet therebetween can be prevented from being mixed in one tray to keep the stability of the stacked sheets.

The control performed by the control unit 205 will be concretely described with reference to FIG. 16. The respective steps illustrated in a flow chart of FIG. 16 are carried out by allowing the control unit 205 to read out a program stored in the ROM 207 and execute the program.

Figure 16:
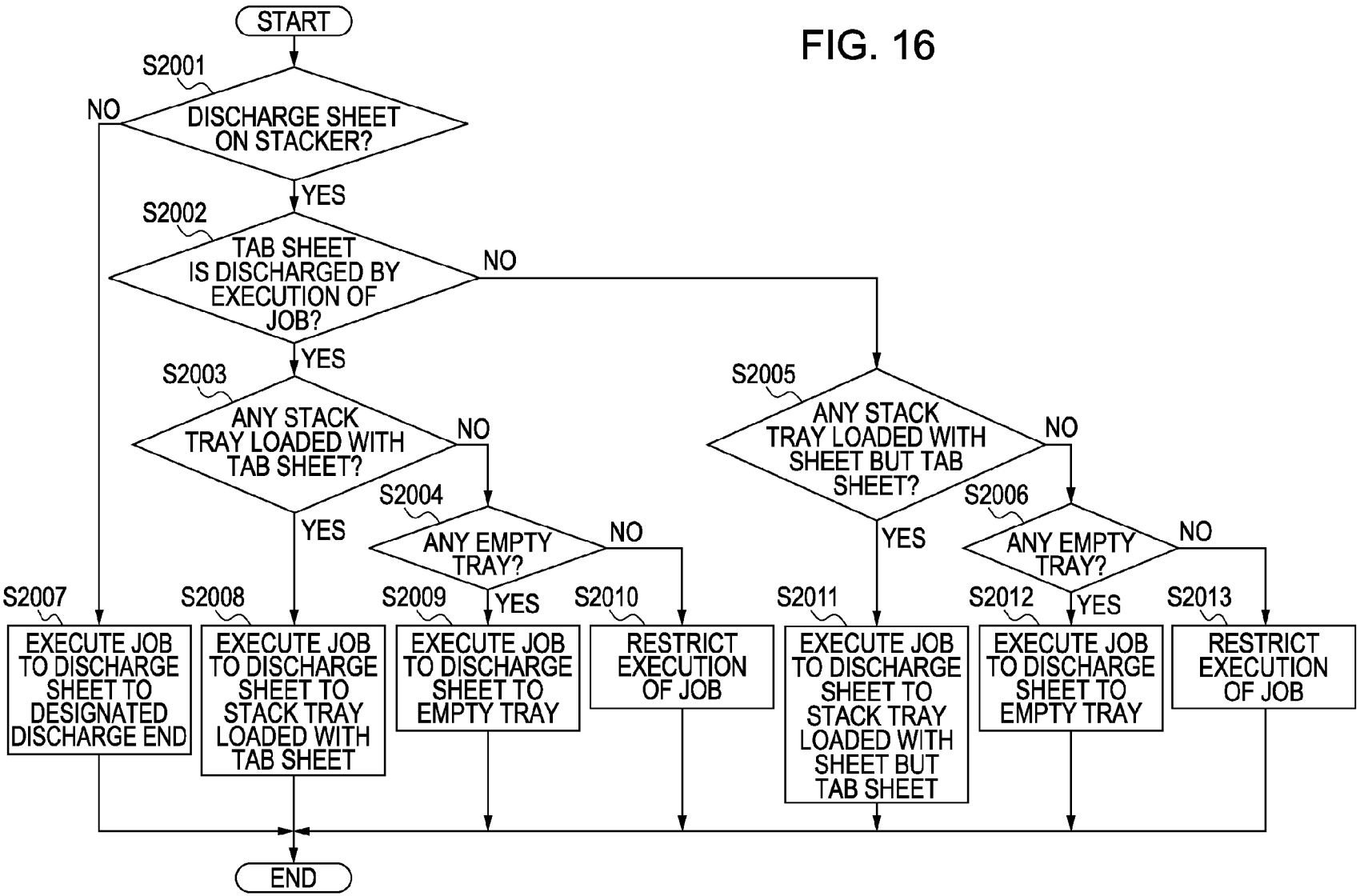
FIG. 16 is a flow chart representing sheet-stacking processing according to the embodiment of the present invention.
Figure 18:
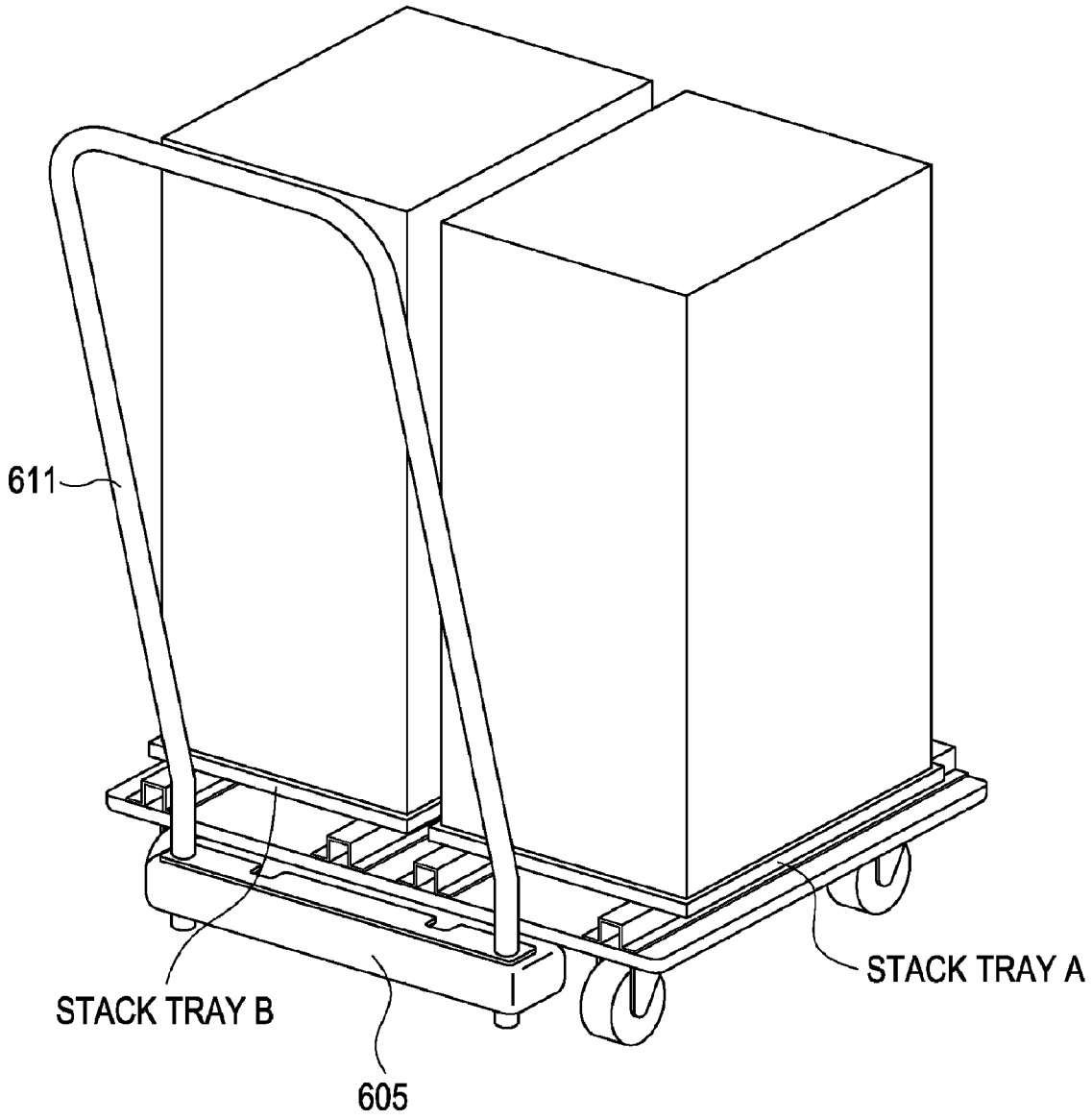
FIG. 18 is a diagram illustrating a cart according to the embodiment of the present invention.

If the control unit 205 receives print setting through the operation unit 204 in a the copy function and the execution of the job is instructed through the start key 404, then the process represented in the flow chart of FIG. 16 is started.

In step S2001, when receiving the instruction of executing the job from the operation unit 204, the control unit 205 enables the RAM 208 to store the received job information. The received information about the job includes, for example, the settings received through the operation unit 204 as shown in FIG. 4 or FIG. 5 (e.g., the information about the type of sheet processing, information about the tab sheet, and the information about the sheet used). When receiving the instruction for executing the job, the control unit 205 performs the processing represented by the flow chart in FIG. 16 based on the information about the job stored in the RAM 208 and the information about the sheets loaded on the stack trays. The information about sheets loaded on the stack trays is stored as stacking state management tables as shown in FIGS. 17A to 17C in the RAM 208, respectively.

FIG. 17A illustrates the state in which there is no sheet stacked on each of the stack trays A and B.

After that, it is consumed that the control unit 205 executes the job 1 which is set to insert the tab sheet between the sheets is executed and the sheet is then ejected to the stack tray, then the control unit 205 changes the state of presence or absence of the sheet on the stack tray A from "absence" to "presence" and also changes the size of the tab sheet from "–" to "B5". The stacking state management table at this time is illustrated in FIG. 17B.

If the control unit 205 subsequently executes job 2 which is not set to insert the tab sheet and ejects a B5 sheet to the stack tray B, then the control unit 205 changes the state of presence or absence of the sheet on the stack tray B from "absence" to "presence" and also changes the information about the tab sheet from "–" to "absence". The stacking state management table at this time is illustrated in FIG. 17C.

The large-capacity stacker includes sensors that detect the presence or absence of sheet stacked on the respective stack trays A and B. If the sensor detects the absence of the sheet, then the large-capacity stacker returns the state of the stacking state management table to one shown in FIG. 17A. For example, if sheets which have been stacked on the stack tray are completely taken out of the stack tray, then there is no sheet stacked on the large-capacity stacker. In this case, the control unit 205 resets the stacking state management table to the state shown in FIG. 17A based on the information from the sensor.

The control unit 205 uses such a stacking state management table to determine whether any sheet is present or absent on each of the stack trays A and B of the large-capacity stacker or whether any tab sheet is present or absent.

In step S2001, according to information about a job, the control unit 205 determines whether a sheet ejected by executing the job should be ejected to the stack tray of the large-capacity stacker. If the job is one set to carry out the processing of loading a large number of sheets through the operation unit 204, then the ejection end of the job is the stack tray of the large-capacity stacker. Therefore, if the job is one set to carry out the processing of loading a large number of sheets, control unit 205, then the control unit 205 concludes that the sheets of the job should be ejected to the stack tray of the large-capacity stacker and then advances the processing to step S2002. On the other hand, if the control unit 205 concludes that the received job is not set to carry out the processing of loading a large number of sheets, then the control unit 205 advances the processing to step S2007.

In step S2007, the control unit 205 performs control so that the sheet can be ejected to the ejection end specified by the job. For example, if the job is set to one to perform case binding, the control unit 205 allows the sheet to be conveyed to the glue binding machine. Then, the sheet is subjected to the case binding processing, followed by being ejected to the paper ejecting section of the glue binding machine. Furthermore, if the job is one set to carry out saddle-stitch binding, the control unit 205 allows the sheet to be conveyed to the saddle stitch binding machine. Then, the sheet is subjected to the saddle-stitch binding, followed by being ejected to the paper ejecting section of the saddle stitch binding machine. Consequently, the processing is ended.

If the process proceeds to step S2002, then the control unit 205 performs the job to determine whether the tab sheet should be ejected. As described above, the user can set a job to insert the tab sheet between the sheets through the operation unit 204. As long as the job is set to insert the tab sheet between the sheets, the tab sheet can be ejected by executing the job. Therefore, if the control unit 205 is concluded that the job is one being set to insert the tab sheet between the sheets based on the information about the job, then the processing is advanced to step S2003. Alternatively, if it is concluded that the job is not one which is not set to insert the tab sheet, then the process proceeds to step S2005.

In step S2003, on the basis of a stacking state management table shown in FIG. 17, the control unit 205 determines whether the stack tray on which the tab sheet is stacked. If it is concluded that the stack tray is one on which the tab sheet is being stacked, then the control unit 205 performs the job in step S2008 and then performs control to eject a sheet on the stack tray on which the tab sheet is being stacked.

In step S2003, on the other hand, if the control unit 205 concludes that there is no stack tray on which the tab sheet is stacked, the control unit 205 determines whether the empty tray on which there is no stacked sheet with reference to the stacking state management table.

Figure 22:
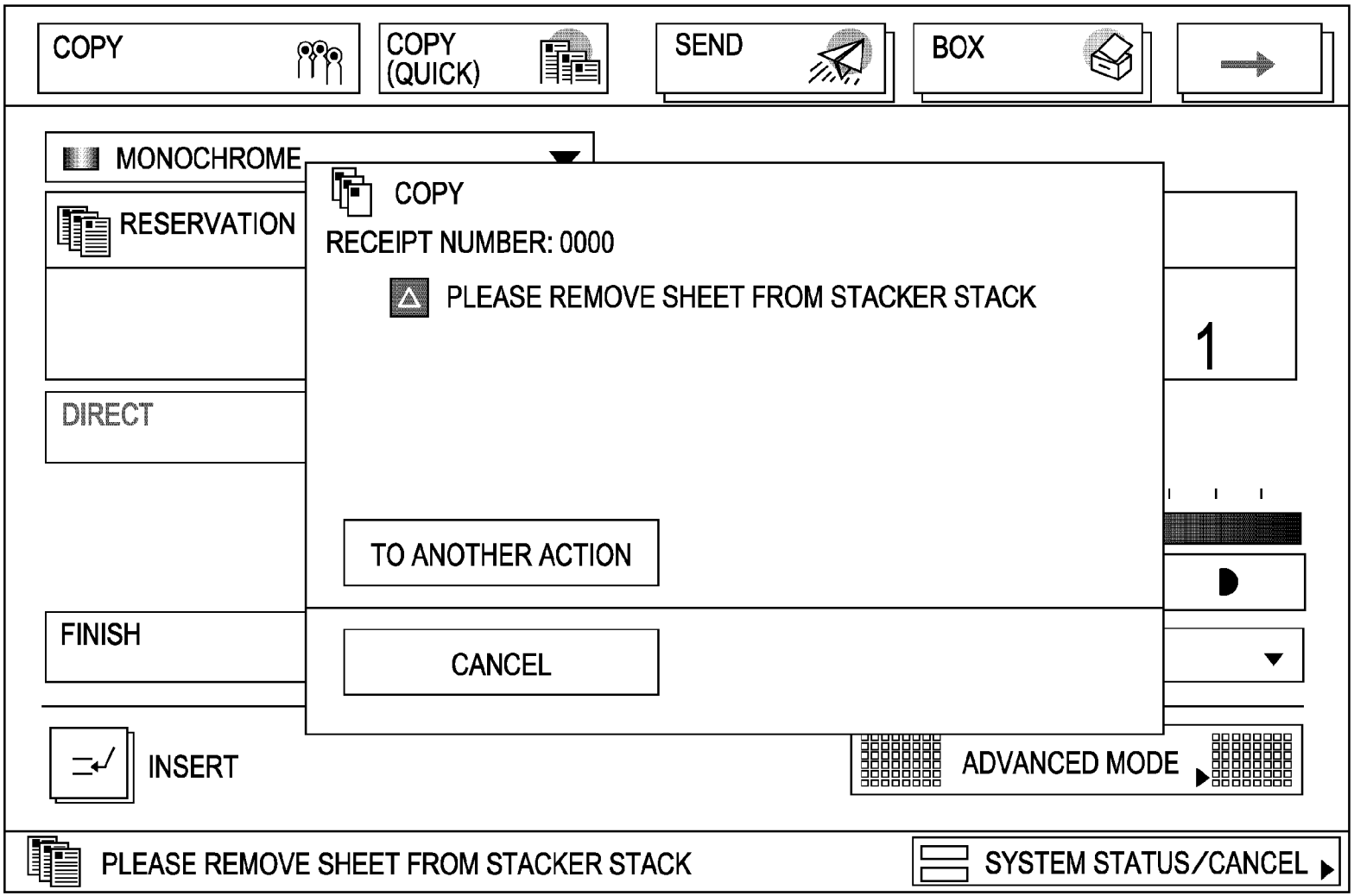
FIG. 22 is a schematic diagram illustrating an operation unit according to the embodiment of the present invention.

If the control unit 205 concludes that there is an empty tray, then the control unit 205 performs control of enabling the empty tray to eject the sheet on the empty tray in step S2009. On the other hand, if the control unit 205 concludes that there is no empty tray, then the control unit 205 saves the job to restrict the execution of the job. This is because the stacked sheets may become unstable as a result of ejecting the tab sheet. Here, the phrase "saves the job" means that the job is saved in a save area of the HDD 209. Here, the control unit 205 displays a message on the operation unit 204 as shown in FIG. 22. Thus, the job which has been saved may be executed when the user has removed the sheets from the large-capacity stacker.

On the other hand, if the processing is advanced from step S2002 to step S2005, then the control unit 205 determines whether there is any stack tray on which sheets are stacked but no tab sheet is stacked thereon.

If the control unit 205 concludes that there is a stack tray on which there is any sheet stacked thereon but no tab sheet is stacked, then the control unit 205 executes the job in step S2011 to eject the sheet to the stack tray.

In step S2005, if the control unit 205 concludes that there is no stack tray on which the sheets are mounted without any stacked tab sheet, then the control unit 205 determines whether there is an empty tray on which no sheet is stacked based on the stacking state table.

If the control unit 205 concludes that there is an empty tray, then the control unit 205 executes the job in step S2012 to control the ejection of the sheet to the empty tray. On the other hand, if the control unit 205 concludes that there is no empty tray, then the control unit 205 saves the job to restrict the execution of the job. This is because the stacked sheets may become unstable as a result of ejecting the tab sheet. Here, the phrase "saves the job" means that the job is saved in a save area of the HDD 209. Here, the control unit 205 displays a message on the operation unit 204 as shown in FIG. 22. Thus, the job which has been saved may be executed when the user has removed the sheets from the large-capacity stacker.

By performing the control as described above, the control unit 205 performs control so that the sheets set to insert the tab sheet therebetween and the sheets not to insert the tab sheet therebetween can be prevented from being mixed in one tray to keep the stability of the stacked sheets.

Second Embodiment

In the first embodiment, the description has been made for the control of making a difference between a conformable position of the sheet ejected by execution of a job which is set to insert a tab sheet between sheets and a conformable position of the sheet ejected by execution of a job which is not set to insert any tab between sheets.

When making a difference between the conformable positions of the sheets as described above, the position of the abutting plate 608 can be frequently changed when the job which is set to insert a tab sheet between sheets and the job which is not set to insert any tab between sheets are alternately performed. For example, if the job which is set to insert the tab sheet between the sheets under the state in which there is no sheet on each the stack tray A and the stack tray B, then the abutting plate 608 is shifted to the position shown in FIG. 7 to stack the sheet while retaining the conformable state of the sheet with the stack tray A. If the job which is not set to insert the tab sheet, then the abutting plate 608 is shifted to the position shown in FIG. 8 to stack the sheet. In this case, the conformable state of the sheet is retained with the stack tray. After that, if the job which is set to insert the tab sheet between the sheets, then the abutting plate 608 is shifted to the position shown in FIG. 7.

In this way, the job which is set to insert any table sheet between the sheets and the job which is not set to insert any tab between the sheets are executed by frequently changing their turns, there is also a need of frequently shifting the position. In this case, the stability of the sheets to be stacked can be maintained but there is a need of delaying the execution of the sheet as long as a time required for moving the abutting plate 608.

Then, in the second embodiment, the control of avoiding a decrease in printing efficiency while keeping the stability of stacked sheets even in the case of frequently making a change between a job which is set to insert a tab sheet between sheet and a job which is not set to insert any tab sheet between sheets will be described.

In the first embodiment, the control has been described with respect to the printing system 1000 having a large-capacity stacker. In the second embodiment, the control will be described with respect to the printing system 1000 having two large-capacity stackers.

Figure 19:
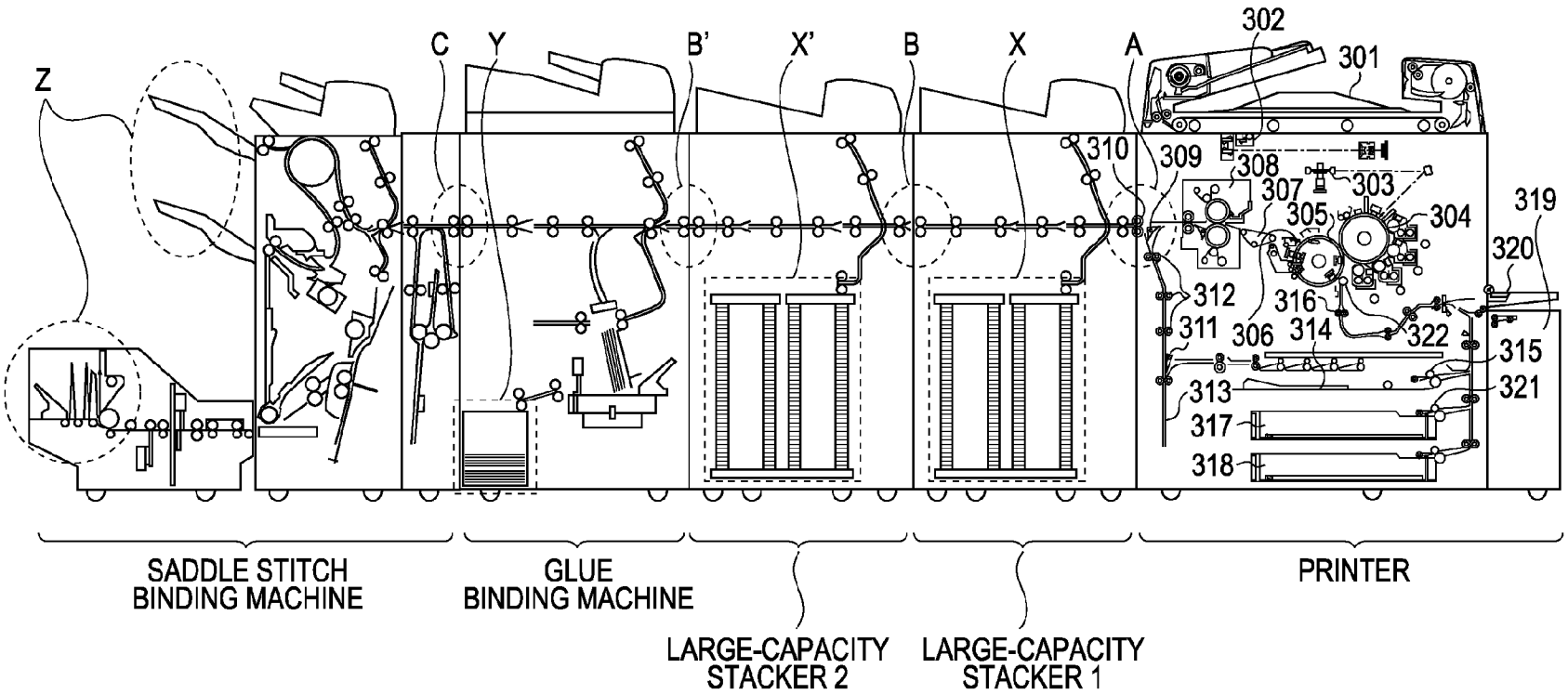
FIG. 19 is a cross-sectional diagram illustrating the configuration of the printing system 10000 according to the embodiment of the present invention.

FIG. 19 is a cross-sectional diagram illustrating the configuration of the printing system 10000 according to the second embodiment of the present invention. In this embodiment, the configuration of a printer 100 and a method of conveying a sheet are the same as those described in the first embodiment, so that the detailed descriptions thereof will be omitted. However, the different configuration and control will be described.

The printing system 1000 includes two large-capacity stackers 1 and 2. Sheets can be stacked on the respective large-capacity stackers 1 and 2 when large-capacity processing is performed through an operation unit 204 by the user. Each large-capacity stacker includes two stack trays.

Figure 20:
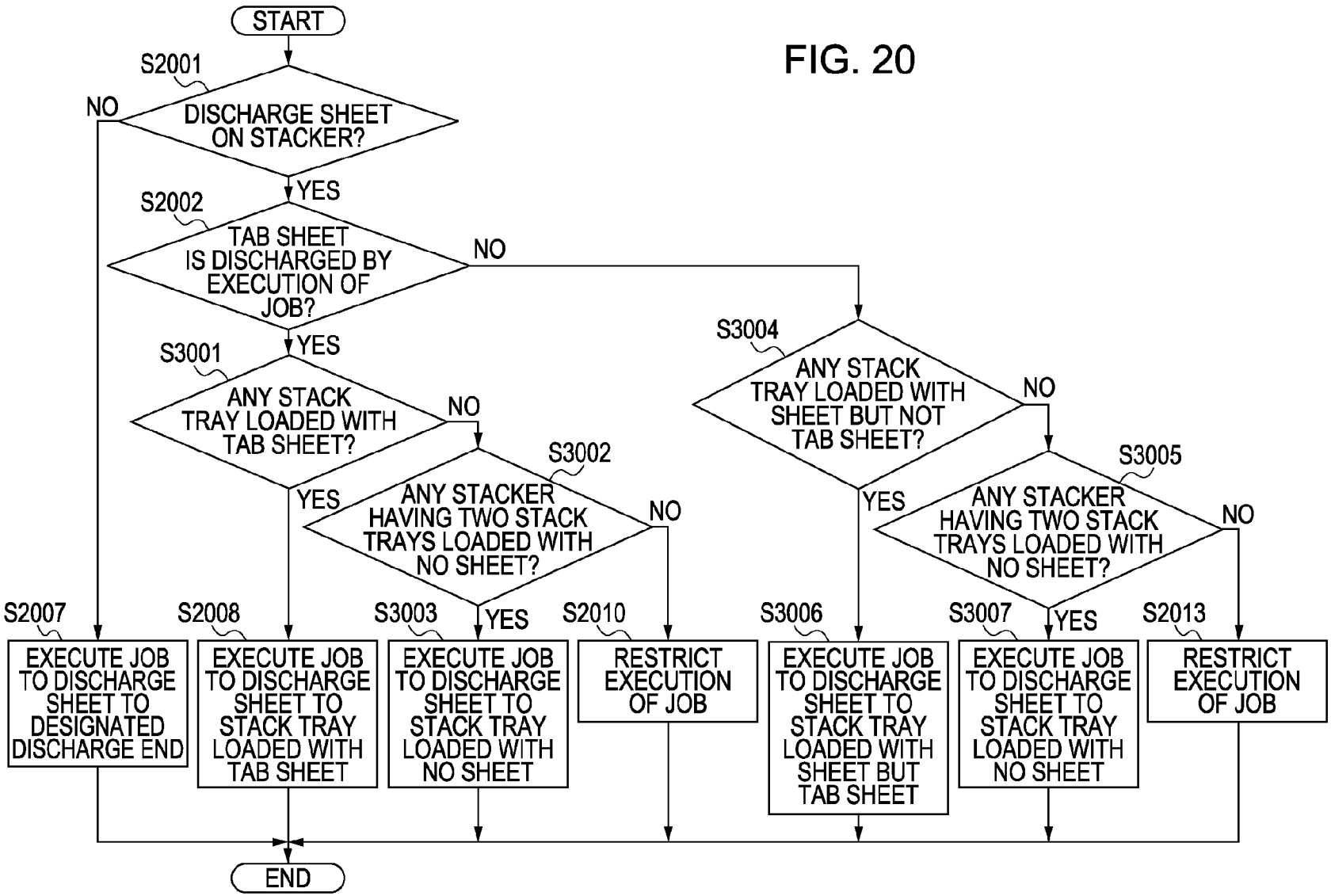
FIG. 20 is a flow chart representing sheet-stacking processing according to the embodiment of the present invention.

The control performed by the control unit 205 using the configuration of such a print system 1000 will be concretely described with reference to FIG. 20. Each step shown in the flow chart of FIG. 20 is processing which is performed by a control unit 205 by reading out a program stored in ROM 207.

The detailed descriptions of the same steps as those of the first embodiment will be omitted because of being provided with the same reference numerals as those of the first embodiment.

If the process proceeds to step S2002, then the control unit 205 allows the processing to proceed to s3001 when the control unit 205 executes a job to conclude that the tab sheet is ejected.

In step S3001, the control unit 205 determines whether the stack tray on which the tab sheet is stacked. Here, the control unit 205 determines whether there is any tab sheet stacked on each of the stack trays C and D of the large-capacity stacker 2 in addition to the stack trays A and B of the large-capacity stacker 1. Here, the configuration of the large-capacity stacker 1 or 2 is different from those shown in the first embodiment. On the basis of a stacking state management table shown in FIG. 21, the control unit 205 determines whether there is any stack tray on which a tab sheet is stacked.

If it is concluded that the stack tray is one on which the tab sheet is being stacked, then the control unit 205 performs the job in step S2008 and then performs control to eject a sheet on the stack tray on which the tab sheet is being stacked.

On the other hand, if it is concluded that there is no stack tray on which a tab sheet is stacked, then the control unit 205 determines whether there is any stacker on which there is no sheet stacked on each of two stack trays in step S3002. In addition, in step S3002, if it is concluded that there is no stack tray on which any sheet is not stacked on each of two stack trays, then the control unit 205 executes a job to perform control so that a sheet can be ejected to the stack tray of the stacker on which no sheet is stacked on each of two stack trays.

On the other hand, if the control unit 205 concludes that there is no stacker in which there is no sheet stacked on each of two stack trays, then the control unit 205 saves the job to restrict the execution of the job in step S2010. This is because the stacked sheets may become unstable as a result of ejecting the tab sheet. Here, the phrase "saves the job" means that the job is saved in a save area of the HDD 209. Here, the control unit 205 displays a message on the operation unit 204 as shown in FIG. 22. Thus, the job which has been saved may be executed when the user has removed the sheets from the large-capacity stacker.

On the other hand, if the processing is advanced from step S2002 to step S3004, then the control unit 205 determines whether there is any stack tray on which sheets are stacked but no tab sheet is stacked thereon in step S3004. If the control unit 205 concludes that there is a stack tray on which any sheet is stacked but no tab sheet is tacked, then the processing is advanced to the process in S2011. Then, the control unit 205 performs control so that a sheet can be ejected to a stack tray where the stacked sheet can be found but no tab sheet is stacked.

On the other hand, if the control unit 205 concludes that there is no stack tray on which any sheet is stacked but no tab sheet is stacked, the processing proceeds to S3005.

In S3005, the control unit 205 determines whether there is any stacker on which there is no sheet stacked on each of two stack trays. In addition, in step S3002, if it is concluded that there is a stack tray on which any sheet is not stacked on each of two stack trays, then the control unit 205 executes a job to perform control so that a sheet can be ejected to the stack tray of the stacker on which no sheet is stacked on each of two stack trays.

When it judges with on the other hand there being no stack tray in which a sheet is not loaded into two stack trays, in S2013, a job is evacuated and execution of a job is restricted. This is because the stacked sheets may become unstable as a result of ejecting the tab sheet. Here, the phrase "saves the job" means that the job is saved in a save area of the HDD 209. Here, the control unit 205 displays a message on the operation unit 204 as shown in FIG. 22. Thus, the job which has been saved may be executed when the user has removed the sheets from the large-capacity stacker.

By controlling as described above in the second embodiment, it is possible to attain the control of avoiding a decrease in printing efficiency while keeping the stability of stacked sheets even in the case of frequently making a change between a job which is set to insert a tab sheet between sheet and a job which is not set to insert any tab sheet between sheets.

The above embodiment has been described such that the sheet of a job which is set to insert any tab sheet on the first stacking position and the sheet of a job which is not set to insert any tab sheet on the second stacking position. Here, the term "sheet of the job" means a sheet ejected by execution of the job, the term "first stacking position" means, for example, a position shown in FIG. 6 or FIG. 8, and the term "second stacking position" means, for example, a position shown in FIG. 7 or FIG. 9. However, the present invention is not limited to such a configuration. Alternative, for example, in the case of ejecting a tab sheet, the sheets may be stacked on the first position. In the case of ejecting a sheet other than the tab sheet, sheet may be stacked on the second position.

Furthermore, in the above embodiment, the large-capacity stackers each including two stack trays has been described. Alternatively, the stacker may include three or more stack trays. In this case, the ejection of sheets to the respective stacker sheets can be realized by individually providing the conveying path of sheets to the respect stack trays from the stack pass of large capacity stacker. Although a case where printing system 1000 had two large-capacity stackers was explained, it can apply, also when three or more sets of large-capacity stackers are connected.

In the above embodiment, the example in which the position of the abutting plate 608 is changed has been described. Alternatively, it is noted there is no need of using a tab sheet as far as the sheet is a sheet that any sheet which should be changed for preventing the partial protrusion of part of the sheet. In this case, the types of sheets that require a change in position of the abutting plate 608 may be previously registered. Thus, if the control unit 205 determines that the previously registered type of the sheet is determined by execution of a job, the control may perform control to change the abutting position. It cannot be overemphasized that the processing shown in FIG. 16 or FIG. 20 as described above is applicable.

Furthermore, the above embodiment has been descried in the case of executing the job using a copy function through the operation unit 204. The same kinds of processing may be applied to the case where a job using a box function that prints image data stored in the HDD 209 is executed. When executing the job using the box function, the user selects image data stored in the HDD 209 through the operation unit 204 and performs print settings to instruct printing of an image. Upon receiving the instruction of printing, the control unit 205 executes the processing of FIG. 16 or FIG. 20 depending on the kind of sheet processing and the ser settings included in the print settings received through the operation unit 204.

In addition, the present embodiment is not limited to the copy function and the box function. Alternatively, the present embodiment is applicable when a job received from an external personal computer (PC) 104. In that case, the user may employ the printer driver of the external PC 104 to determine the kind of sheet processing, the settings of whether the tab sheet is inserted, the settings of a sheet for printing and then transmits the job to the printing system 1000. If the control unit 205 of the printing system 1000 receives a job from the external PC 104, then it executes the processing of FIG. 10 depending on the settings of the received job.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-324456, filed on Dec. 19, 2008, which is hereby incorporated by reference herein in its entirety.

What is claimed is:

1. An apparatus comprising:

a receiving unit configured to receive a job;

a determining unit configured to determine whether a tab sheet is used by the job received by the receiving unit; and a stacking unit configured to control to stack a sheet for the job on a first position of a stacking tray in a case where the determining unit determines that the tab sheet is not used by the job and to control to stack a sheet for the job on a second position of the stacking tray in a case where the determining unit determines that the tab sheet is used by the job, wherein the stacking unit does not stack the sheet for a second job which uses the tab sheet on the second position when the sheet for a first job which does not use the tab sheet is stacked on the first position of the stacking tray, and does not stack the sheet for the second job which does not use the tab sheet on the first position when the sheet for the first job which uses the tab sheet is stacked on the second position of the stacking tray.

2. The apparatus according to claim 1, wherein the stacking unit controls to stack the sheet on any of a plurality of stacking trays, and the stacking unit controls to stack, when the sheet for the first job is already stacked on the first position, the sheet for the second job on a stacking tray different from the stacking tray on which the sheet for the first job is stacked.

3. The apparatus according to claim 1, wherein the stacking unit controls to stack the sheet on any of a plurality of stacking trays in a first sheet stacking apparatus or on a stacking tray in a second sheet stacking apparatus.

4. The apparatus according to claim 3, wherein the stacking unit controls, when the sheet for the first job is stacked on any of the plurality of stacking trays in the first sheet stacking apparatus, so that the sheet for the second job is stacked on the stacking tray in the second sheet stacking apparatus without being stacked on the other stacking tray in the first sheet stacking apparatus even if a sheet is not stacked on the other stacking tray in the first sheet stacking apparatus.

5. The apparatus according to claim 1, further comprising:

a notifying unit configured to notify a user to remove a sheet stacked on the stacking tray in a case where the sheet of the first job is already stacked on the first position.

6. A method for controlling an apparatus, the method comprising:

receiving a job;

determining whether a tab sheet is used by the received job; and stacking a sheet for the job on a first position of a stacking tray in a case where the determining unit determines that the tab sheet is not used by the job or stacking a sheet for the job on a second position of the stacking tray in a case where the determining unit determines that the tab sheet is used by the job, wherein the sheet for a second job, which uses the tab sheet, is not stacked on the second position when the sheet for a first job, which does not use the tab sheet is stacked on the first position of the stacking tray, and the sheet for the second job, which does not use the tab sheet, is not stacked on the first position when the sheet for the first job, which uses the tab sheet, is stacked on the second position of the stacking tray.

7. The method according to claim 6, wherein the sheet is stacked on any of the plurality of stacking trays, and when the sheet for the first job is already stacked on the first position, the sheet for the second job is stacked, on a stacking tray different from the stacking tray on which the sheet for the first sheet is stacked.

8. The method according to claim 6, wherein the sheet is stacked on any of a plurality of stacking trays in a first sheet stacking apparatus or on a stacking tray in a second sheet stacking apparatus which is different from the first sheet stacking apparatus.

9. The method according to claim 8, wherein when the sheet for the first job is stacked on any of the plurality of stacking trays in the first sheet stacking apparatus, performing stacking so that the sheet for the second job is stacked on the stacking tray in the second sheet stacking apparatus without being stacked on the other stacking trays in the first sheet stacking apparatus even if a sheet is not stacked on the other stacking trays in the first sheet stacking apparatus.

10. The method according to claim 6, further comprising:

notifying a user to remove a sheet stacked on the stacking tray in a case where the sheet for the first job is already stacked on the first position.

11. A non-transitory computer readable storage medium for storing a computer-executable program of instructions for causing a computer to perform a method for controlling an apparatus, the method comprising:

a code to receive a job;

a code to determine whether a tab sheet is used by the received job; and a code to control to stack a sheet for the job on a first position of a stacking tray in a case where it is determined that the tab sheet is not used by the job and to control to stack a sheet for the job on a second position of the stacking tray in a case where it is determined that the tab sheet is used by the job, wherein the sheet for a second job, which uses the tab sheet, is not stacked on the second position when the sheet for a first job, which does not use the tab sheet, is stacked on the first position of the stacking tray, and the sheet for the second job, which does not use the tab sheet, is not stacked on the first position when the sheet for the first job, which uses the tab sheet, is stacked on the second position of the stacking tray.

12. The non-transitory computer readable storage medium according to claim 11, wherein the sheet is stacked on any of a plurality of stacking units, and the sheet for the second job is stacked on a stacking tray different from the stacking tray on which the sheet for the first job is stacked.

13. The non-transitory computer readable storage medium according to claim 11, further comprising:

a code to notify a user to remove a sheet stacked on the stacking tray in a case where the sheet for the first sheet is already stacked on the first position.

14. A method for controlling an apparatus, the method comprising:

receiving a job;

determining whether a tab sheet is used by the received job; and controlling to stack a sheet for the job on a first position of a stacking tray in a case where it is determined that the tab sheet is not used by the job and controlling to stack a sheet for the job on a second position of the stacking tray in a case where it is determined that the tab sheet is used by the job, wherein the sheet for a second job, which uses the tab sheet, is not stacked on the second position when the sheet for a first job, which does not use the tab sheet, is stacked on the first position of the stacking tray, and the sheet for the second job, which does not use the tab sheet, is not stacked on the first position when the sheet for the first job, which uses the tab sheet, is stacked on the second position of the stacking tray.

15. An apparatus comprising:

a receiving unit configured to receive a job;

a determining unit configured to determine whether a tab sheet is used by the job received by the receiving unit; and a stacking unit configured to control to stack a sheet for the job on a first position of a stacking tray in a case where the determining unit determines that the tab sheet is not used by the job and to control to stack a sheet for the job on a second position of the stacking tray in a case where the determining unit determines that the tab sheet is used by the job, wherein the stacking unit does not stack the sheet for a second job, which uses the tab sheet, on the second position when the sheet for a first job, which does not use the tab sheet, is stacked on the first position of the stacking tray.

16. An apparatus comprising:

a receiving unit configured to receive a job;

a determining unit configured to determine whether a tab sheet is used by the job received by the receiving unit; and a stacking unit configured to control to stack a sheet for the job on a first position of a stacking tray in a case where the determining unit determines that the tab sheet is not used by the job and to control to stack a sheet for the job on a second position of the stacking tray in a case where the determining unit determines that the tab sheet is used by the job, wherein the stacking unit does not stack the sheet for a second job, which uses the tab sheet, on the first position when the sheet for a first job, which does not use the tab sheet, is stacked on the second position of the stacking tray.

* * * * *